US007354507B2

(12) United States Patent
Gopalakrishnan et al.

(10) Patent No.: US 7,354,507 B2
(45) Date of Patent: Apr. 8, 2008

(54) HYDROPROCESSING METHODS AND APPARATUS FOR USE IN THE PREPARATION OF LIQUID HYDROCARBONS

(75) Inventors: Sridhar Gopalakrishnan, Ponca City, OK (US); Vincent H. Melquist, Willmar, MN (US); Rafael L. Espinoza, Ponca City, OK (US); Doug S. Jack, Ponca City, OK (US); Keith Henry Lawson, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 339 days.

(21) Appl. No.: 10/802,974

(22) Filed: Mar. 17, 2004

(65) Prior Publication Data

US 2005/0205462 A1 Sep. 22, 2005

(51) Int. Cl.
*C10G 65/00* (2006.01)

(52) U.S. Cl. ..... 208/78; 208/80; 208/58; 208/15; 585/14

(58) Field of Classification Search ..... 208/58, 208/78, 80, 15; 585/14
See application file for complete search history.

(56) References Cited

U.S. PATENT DOCUMENTS 3,240,694 A 3/1966 Mason et al.
3,243,367 A 3/1966 Mason et al.
3,260,663 A 7/1966 Inwood et al.
3,579,435 A 5/1971 Olenzak et al.
4,615,789 A 10/1986 Bridge et al. ..... 208/143
4,851,109 A 7/1989 Chen et al.
4,943,672 A * 7/1990 Hamner et al. ..... 585/737
5,378,348 A 1/1995 Davis et al. ..... 208/27

(Continued)

FOREIGN PATENT DOCUMENTS

EP 0 583 836 A1 2/1994

(Continued)

OTHER PUBLICATIONS

Enrique Iglesia et al., "Fischer-Tropsch Synthesis on Cobalt and Ruthenium. Metal Dispersion and Support Effects on Reaction Rate and Selectivity," *Journal of Catalysis*, vol. 137, pp. 212-224 (1992).

(Continued)

*Primary Examiner*—Glenn Caldarola
*Assistant Examiner*—John Douglas
(74) *Attorney, Agent, or Firm*—Conley Rose P.C.

(57) ABSTRACT

The present invention is generally related towards enhancing the yield and/or cold-flow properties of certain hydrocarbon products, increasing the degree of isomerization in a diesel product and/or increasing the production rate of a diesel product. The embodiments generally include reducing the residence time of lighter hydrocarbon fractions during hydrocracking, thereby decreasing secondary cracking, by various configurations of introducing at least two hydrocarbon feedstreams of different boiling ranges at different entry points in a hydrocracking unit. A method further includes forming a hydrocarbons stream comprising primarily $C_{5+}$ Fischer-Tropsch hydrocarbon products; fractionating hydrocarbons stream to form at least a wax fraction and an intermediate fraction which serve as separate feedstreams to a hydrocracking unit comprising at least two hydroconversion zones. One embodiment comprises the use of a bifunctional catalyst in one of the hydrocracking zones so as to favor hydroisomerization of hydrocarbons to favor the formation of branched paraffins boiling in the diesel range.

41 Claims, 6 Drawing Sheets

U.S. PATENT DOCUMENTS

| | | | | |
|---|---|---|---|---|
| 5,603,824 | A | 2/1997 | Kyan et al. | |
| 5,645,613 | A | 7/1997 | Benham et al. | 44/452 |
| 5,689,031 | A | 11/1997 | Berlowitz et al. | 585/734 |
| 5,766,274 | A | 6/1998 | Wittenbrink et al. | 44/436 |
| 5,888,376 | A * | 3/1999 | Wittenbrink et al. | 208/59 |
| 5,904,835 | A | 5/1999 | Thakkar et al. | |
| 6,017,443 | A | 1/2000 | Buchanan | 208/210 |
| 6,043,288 | A | 3/2000 | DeGeorge et al. | 518/715 |
| 6,113,775 | A | 9/2000 | Christolini et al. | |
| 6,296,757 | B1 | 10/2001 | Wittenbrink et al. | 208/15 |
| 6,299,759 | B1 | 10/2001 | Bradway et al. | |
| 6,333,294 | B1 | 12/2001 | Chao et al. | 502/325 |
| 6,359,018 | B1 | 3/2002 | O'Rear et al. | |
| 6,402,989 | B1 | 6/2002 | Gaffney | 252/373 |
| 6,583,186 | B2 | 6/2003 | Moore, Jr. | |
| 6,589,415 | B2 | 7/2003 | Smith et al. | |
| 6,656,342 | B2 | 12/2003 | Smith et al. | |
| 6,689,273 | B1 | 2/2004 | Kalnes et al. | |
| 2001/0004971 | A1 | 6/2001 | Wittenbrink et al. | 208/15 |
| 2002/0146358 | A1 | 10/2002 | Smith et al. | 422/188 |
| 2003/0019788 | A1 | 1/2003 | Benazzi et al. | |
| 2003/0057133 | A1 * | 3/2003 | Benazzi et al. | 208/49 |
| 2003/0057135 | A1 | 3/2003 | Benazzi et al. | |
| 2004/0173501 | A1 | 9/2004 | Lawson et al. | |

FOREIGN PATENT DOCUMENTS

| | | |
|---|---|---|
| WO | WO 00/20535 | 4/2000 |
| WO | WO 01/59034 | 8/2001 |
| WO | WO 03/042333 A1 | 5/2003 |

OTHER PUBLICATIONS

Harold Gunardson, "Synthesis Gas Manufacture," *Industrial Gases in Petrochemical Processing,* Chp. 2:41-80 (1998).

International Search Report dated Oct. 3, 2006.

PCT Search Report for International Application No. PCT/US05/04746 dated Oct. 3, 2006 (3 pg).

PCT Written Opinion for International Application No. PCT/US05/04746 dated Oct. 3, 2006 (6 pg).

* cited by examiner

HYDROPROCESSING METHODS AND APPARATUS FOR USE IN THE PREPARATION OF LIQUID HYDROCARBONS

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention is generally related towards the field of converting hydrocarbon gas to liquid hydrocarbons. In particular, the present invention provides a hydroprocessing method and apparatus for improving products prepared as liquid hydrocarbons from synthesis gas. More particularly, the present invention provides a method and apparatus for enhancing the yield and cold-flow properties of certain hydrocarbon products.

BACKGROUND OF THE INVENTION

Natural gas, found in deposits in the earth, is an abundant energy resource. For example, natural gas commonly serves as a fuel for heating, cooking, and power generation, among other things. The process of obtaining natural gas from an earth formation typically includes drilling a well into the formation. Wells that provide natural gas are often remote from locations with a demand for the consumption of the natural gas.

Thus, natural gas is conventionally transported large distances from the wellhead to commercial destinations in pipelines. This transportation presents technological challenges due in part to the large volume occupied by a gas. Because the volume of a gas is so much greater than the volume of a liquid containing the same number of molecules, the process of transporting natural gas typically includes chilling and/or pressurizing the natural gas in order to liquefy it. However, this contributes to the final cost of the natural gas.

Further, naturally occurring sources of crude oil used for liquid fuels such as gasoline and middle distillates have been decreasing and supplies are not expected to meet demand in the coming years. Middle distillates typically include heating oil, jet fuel, diesel fuel, and kerosene. Fuels that are liquid under standard atmospheric conditions have the advantage that in addition to their value, they can be transported more easily in a pipeline than natural gas, since they do not require energy, equipment, and expense required for liquefaction.

Thus, for all of the above-described reasons, there has been interest in developing technologies for converting natural gas to more readily transportable liquid fuels, i.e. to fuels that are liquid at ambient temperatures and pressures. One method for converting natural gas to liquid fuels involves two sequential chemical transformations. In the first transformation, natural gas or methane, the major chemical component of natural gas, is reacted with water and/or molecular oxygen to form syngas, which is a combination of carbon monoxide gas and hydrogen gas. In the second transformation, known as the Fischer-Tropsch synthesis, carbon monoxide is reacted with hydrogen to form organic molecules containing carbon and hydrogen, known as hydrocarbons. In addition, other organic molecules containing oxygen in addition to carbon and hydrogen known as oxygenates may be formed during the Fischer-Tropsch process. Hydrocarbons comprising hydrogen and carbon atoms with no unsaturated carbon-carbon bonds are know as paraffins. Paraffins with a straight carbon chain are known as linear paraffins, which include normal alkanes. Paraffins with a branched carbon chain are known as isoparaffins. Isoparaffins comprise isomers of linear paraffins. Isomers are molecules having the same molecular formula as another molecule, but having a different structure and, therefore, different properties. As the carbon atoms in a paraffin molecule increase, the number of possible combinations, or isomers, increases sharply. For example, octane, an 8-carbon-atom molecule, has 18 isomers; decane, a 10-carbon-atom molecule, has 75 isomers. Paraffins are particularly desirable as the basis of synthetic diesel fuel.

Typically the Fischer-Tropsch product stream contains hydrocarbons having a range of numbers of carbon atoms, and thus having a range of molecular weights. Thus, the Fischer-Tropsch products produced by conversion of natural gas commonly contain a range of hydrocarbons including gases, liquids and waxes. Depending on the molecular weight product distribution, different Fischer-Tropsch product mixtures are ideally suited to different uses. In the Fischer-Tropsch process, synthesis gas is catalytically transformed into a hydrocarbon product. The hydrocarbon product primarily comprises normal paraffins. It is generally free of heteroatomic impurities such as sulfur, nitrogen or metals. The hydrocarbon product contains practically no aromatics, naphthenes or, more generally, cyclic compounds, in particular when cobalt catalysts are used. In contrast, the Fischer-Tropsch hydrocarbon product can include a non-negligible quantity of oxygen-containing compounds which, expressed as the weight of oxygen, is generally less than about 10% by weight, and also a quantity of unsaturated compounds (generally olefins) that is generally less than 15% by weight. However, the Fischer-Tropsch product fractions, primarily comprising normal paraffins, cannot be used as they are, in particular because their cold properties are not compatible with the normal use of petroleum cuts. As an example, the pour point of a linear hydrocarbon containing 20 carbon atoms per molecule (boiling point of about 340° C., i.e., usually included in the middle distillate cut) is about +37° C. rendering it impossible to use, as the specification for diesel fuel pour point is −15° C. Fischer-Tropsch hydrocarbon product, mainly comprising linear paraffins, must be transformed into products with a higher added value such as diesel, or kerosene, which are obtained after further hydroprocessing. For example, hydrocarbon waxes from Fischer-Tropsch may be subjected to an additional processing step for conversion to liquid and/or gaseous hydrocarbons and/or for conversion to more branched hydrocarbons. Thus, in the production of a Fischer-Tropsch product stream for processing to a fuel it is desirable to maximize the production of high value liquid hydrocarbons, such as hydrocarbons with at least 5 carbon atoms per hydrocarbon molecule ($C_{5+}$ hydrocarbons) as well as to enhance some of the cold flow properties of some liquid fuel obtained therefrom.

These processes are well known, but are continually under development in an attempt to enhance the quality of the liquid hydrocarbon products and increase product yields. The embodiments disclosed herein are directed towards these and other related goals.

SUMMARY OF THE INVENTION

The present invention is generally directed towards an improvement in preparing liquid hydrocarbons. In particular, the present invention provides methods and apparatus for enhancing the yield and/or cold-flow properties of certain hydrocarbon products, increasing the degree of isomerization in the diesel product and/or increasing the production rate of the diesel product.

In general, the disclosed embodiments of the present invention comprise apparatus and methods in which hydrocarbons are: (a) fractionated into at least two fractions, wherein the at least two fractions have different boiling point ranges; (b) reacting at least a portion of one of the fractions in a first hydrocracking reaction zone to produce a first product stream; (c) and reacting at least a portion of a second fraction in a second hydrocracking zone to produce a second product stream. The two hydrocracking zones can be operated in parallel or in series. In a preferred embodiment, one hydrocracking zone is placed downstream of the other hydrocracking zone, thereby receiving an effluent stream from the upstream hydrocracking zone. In an alternate embodiment, the hydrocarbons are passed through a hydrotreating zone prior to fractionation.

Most of the other embodiments of the present invention include at least one or more of the following variations to the general embodiment: feeding at least a portion of the first product stream to the second hydrocracking zone; reacting a heavier fraction in the first hydrocracking zone and a lighter fraction in the second hydrocracking zone; and fractionating one or more of the hydrocracked product streams to produce at least a middle distillate.

A preferred embodiment of the present invention comprises feeding a heavy hydrocarbon stream at an entry point in the hydrocracking unit, while feeding a light hydrocarbon stream to the hydrocracking unit at an entry point located downstream of the entry point for the heavy hydrocarbon stream, such as to minimize cracking of hydrocarbons in the diesel and/or gasoline range, and increase the yield of desirable products (diesel and/or gasoline).

Another preferred embodiment of the present invention further comprises employing two hydroconversion zones, wherein at least one zone comprises a bifunctional catalyst suitable for promoting hydroisomerization, dewaxing, or combinations thereof. The use of a bifunctional catalyst in a downstream hydroconversion zone in a series of hydroconversion zones is particularly preferred, so as to form branched hydrocarbons in the diesel range, and to increase the degree of branching of a diesel product obtained therefrom, and hence, one or more of the cold flow properties of a desirable diesel product.

A preferred embodiment of a method for increasing the degree of isomerization of a diesel product from a Fischer-Tropsch synthesis comprises: (A) reacting a mixture of hydrogen and carbon monoxide at conversion promoting conditions so as to form a synthetic hydrocarbon stream, wherein the synthetic hydrocarbon stream comprises primarily $C_{5+}$ paraffins; (B) forming a fractionator feedstream comprising the synthetic hydrocarbon stream; (C) separating the fractionator feedstream into at least three fractions: a light fraction; an intermediate fraction; and a heavy fraction; wherein the light fraction has a boiling range with a 5% boiling point of about 300° F., wherein the intermediate fraction has a boiling range with a 5% boiling point lower than that of the heavy fraction, and higher than that of the light fraction; (D) passing substantially all of the heavy fraction to a first hydroconversion zone containing a hydrocracking catalyst; (E) reacting portion of said heavy fraction with hydrogen under hydrocracking promoting conditions in the first hydroconversion zone to form a first hydroconverted effluent; (F) passing at least a portion of said first hydroconverted effluent to a second hydroconversion zone; (G) passing at least a portion of the intermediate fraction to the second hydroconversion zone; (H) reacting portion of said first hydroconverted effluent and portion of the intermediate fraction with hydrogen in the second hydroconversion zone with a catalyst under conditions suitable to promote hydroisomerization, hydrocracking, dewaxing, or combinations thereof, to form a second hydroconverted effluent, wherein the portion of the intermediate fraction passed to the second and the portion of the first hydroconverted effluent passed through the second hydroconversion zone have lost their separate identities; (I) separating the second hydroconverted effluent produced in step (H) to create at least a middle distillate fraction therefrom; and (J) forming a synthetic paraffinic fuel by blending at least a portion of the light fraction from step (b); at least a portion of the middle distillate fraction from step (I); and optionally, a portion of the intermediate fraction from step (B) not passed to second hydroconversion zone.

A method for increasing the production yield of a diesel product primarily derived from a Fischer-Tropsch synthesis comprises: A) providing a hydrocarbon stream comprising $C_{5+}$ hydrocarbons, wherein a majority of said $C_{5+}$ hydrocarbons are products of a Fischer-Tropsch synthesis; B) optionally, reacting said hydrocarbon stream with hydrogen in a hydrotreater under hydrotreating promoting conditions to form a hydrotreated hydrocarbon stream comprising primarily of $C_{5+}$ paraffins; C) separating by fractionation the hydrocarbon stream into at least i) a wax fraction comprising a boiling range with a 5% boiling point $T_H$, wherein $T_H$ is equal to or greater than about 640° F.;

ii) an intermediate fraction comprising a boiling range with a 5% boiling point $T_I$ and a 95% boiling point $T_J$, wherein $T_J$ is between about $T_H$−100° F. and $T_H$+150° F., and wherein $T_I$ is between about 500° F. and $T_J$−50° F.; and;

iii) a middle distillate fraction comprising a boiling range with a 5% boiling point between about 330° F. and about 350° F., and a 95% boiling point $T_k$, wherein $T_k$ is between about $T_I$−50° F. and $T_I$+50° F., if $T_I$ is less than about 640° F., or $T_k$ is equal to about 640° F. if $T_I$ is greater than about 640° F.

D) passing substantially all of the wax fraction in a first hydroconversion zone under hydrocracking promoting conditions to convert with hydrogen at least a portion of wax fraction and to form hydroconverted hydrocarbons; E) feeding at least a portion of the hydroconverted hydrocarbons and unconverted hydrocarbons from the first hydroconversion zone and at least a portion of the intermediate fraction to a second hydroconversion zone under suitable conditions for hydroisomerizing and/or dewaxing to react hydrocarbons with hydrogen and to form a hydroconverted effluent; and F) feeding said hydroconverted effluent to the fractionator of step (C), and forming a diesel product, wherein said diesel product comprises at least a portion of the resulting middle distillate fraction and optionally a portion of the intermediate fraction if $T_J$ is less than about 640° F.

Alternative embodiments of the present invention comprise having a plurality of hydrocracking zones separately fed by multiple hydrocarbon streams with various boiling point ranges. The different hydrocarbon streams are fed into the multiple hydrocracking zones successively. For example, a $C_{60+}$ stream may be fed into a first zone with $C_{50}$-$C_{60}$, $C_{50}$-$C_{40}$, $C_{30}$-$C_{40}$and $C_{20}$-$C_{30}$ streams being fed into subsequent downstream successive zones. Another embodiment comprising an upstream zone and a downstream zone includes passing a $C_{20+}$ stream to the upstream zone under hydrocracking promoting conditions to form an upstream zone effluent, and passing the upstream zone effluent and a $C_{20-}$ stream to the downstream zone to form a hydrocracked product. In addition, the embodiments of the present invention include methods for producing liquid hydrocarbons derived from hydrocarbon gas using at least the general embodiments disclosed herein with respect to the hydroprocessing the hydrocarbon products.

Other embodiments are within the spirit of the present invention and are disclosed herein or will be readily understood by those of ordinary skill in the art. All of these and other embodiments, features and advantages of the present invention will become apparent with reference to the following detailed description and drawings.

BRIEF DESCRIPTION OF THE DRAWINGS

For a more detailed understanding of the present invention, reference is made to the accompanying Figures, wherein.

NOTATION, NOMENCLATURE, AND DEFINITIONS

Figure 1:
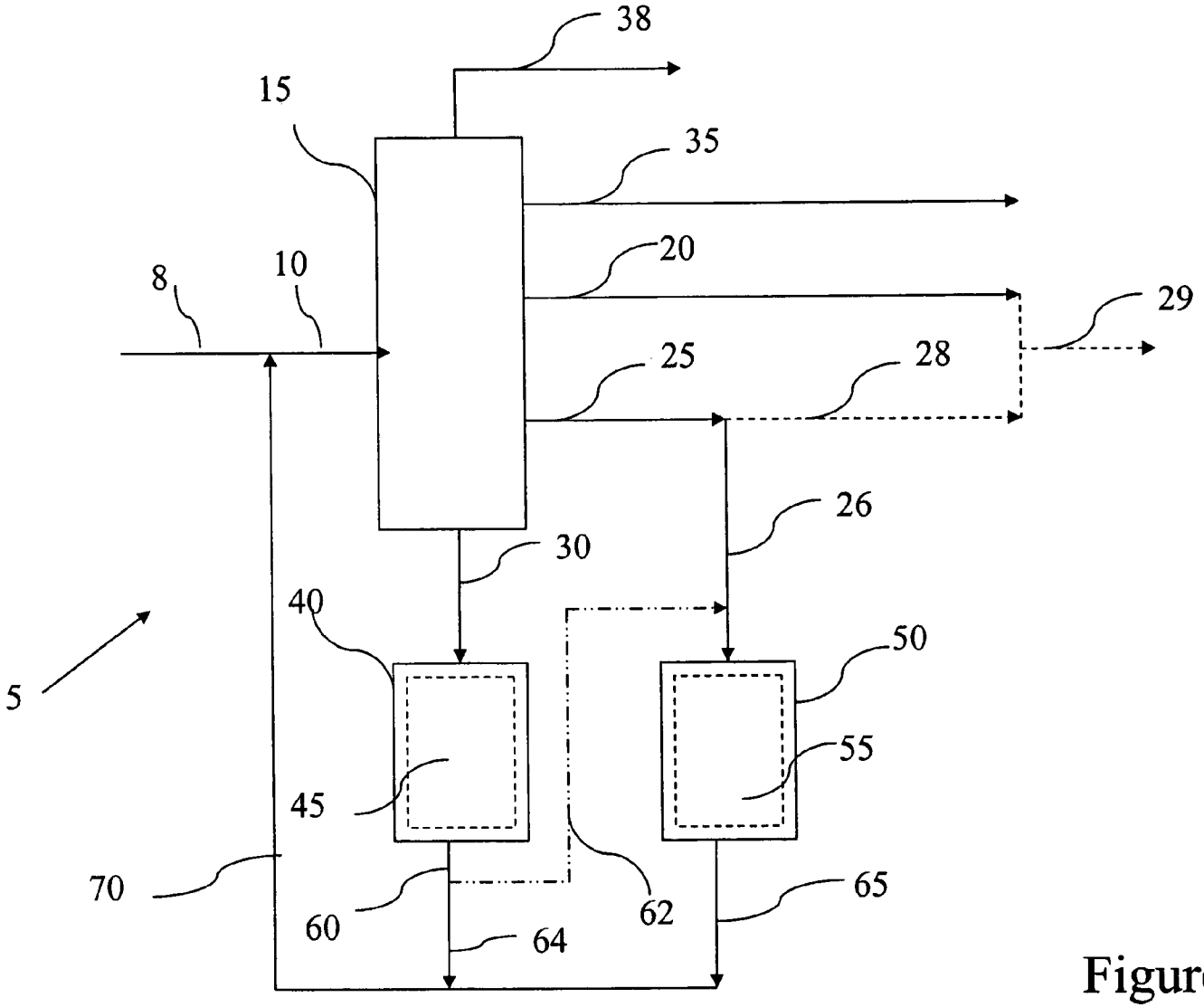
FIG. 1 shows a flow diagram having two hydrocracking zones in parallel fed by two hydrocarbon feed streams in accordance with at least one embodiment of the invention.

Certain terms are used throughout the following description and claims to refer to particular system components. As one skilled in the art will appreciate, individuals and companies may refer to a component by different names. This document does not intend to distinguish between components that differ in name but not function. The terms used herein are intended to have their customary and ordinary meaning. The disclosure should not be interpreted as disclaiming any portion of a term's ordinary meaning. Rather, unless specifically stated otherwise, definitions or descriptions disclosed herein are intended to supplement, i.e., be in addition to, the scope of the ordinary and customary meaning of the term or phrase.

As used herein, a "$C_n$ hydrocarbon" represents a hydrocarbon with 'n' carbon atoms, and "$C_{n+}$ hydrocarbons" represents hydrocarbons with 'n' or more carbon atoms; and "$C_{m-}$ hydrocarbons" represents hydrocarbons with 'm' or less carbon atoms.

"Heteroatomic compounds" represent organic compounds, which comprise not only carbon and hydrogen, but also other atoms, such as nitrogen, sulfur, and/or oxygen. The non-carbon and non-hydrogen atoms (e.g., oxygen, sulfur and nitrogen, respectively) are "heteroatoms". Examples of heteroatomic compounds comprising oxygen are alcohols, aldehydes, esters, ketones, and the like. Examples of heteroatomic compounds comprising sulfur are mercaptans, thiophenes, and the like. Examples of heteroatomic compounds comprising nitrogen are amines. For example, methyl propyl ketone ($CH_3COC_3H_7$), 1-pentanol ($C_5H_{11}OH$), decyl mercaptan ($C_{10}H_{22}S$), and dipropyl amine ($(C_3H_7)_2NH$) are heteroatomic compounds.

As used herein, to "hydroprocess" means to treat a hydrocarbon stream with hydrogen.

As used herein, to "hydrotreat" generally refers to the saturation of unsaturated carbon-carbon bonds and removal of heteroatoms (oxygen, sulfur, nitrogen) from heteroatomic compounds. To "hydrotreat" means to treat a hydrocarbon stream with hydrogen without making any substantial change to the carbon backbone of the molecules in the hydrocarbon stream. For example, hydrotreating a hydrocarbon stream comprising predominantly an alkene with an unsaturated C=C bond in the alpha position (first carbon-carbon bond in the carbon chain) would yield a hydrocarbon stream comprising predominantly the corresponding alkane (e.g., for hydrotreating of alpha-pentene, the ensuing reaction follows: $H_2C{=}CH{-}CH_2{-}CH_2{-}CH_3+H_2 \rightarrow CH_3{-}CH_2{-}CH_2{-}CH_2{-}CH_3$).

As used herein, "ultra-low severity" hydrotreatment means hydrotreatment at conditions such that a substantial portion of the olefins in a stream becomes saturated, but a substantial amount of the heteroatoms in the stream remain attached to their parent molecule. Two of the most important factors in determining whether a hydrotreating process does not convert a substantial amount of, for example, oxygenates to paraffins are catalyst composition and temperature.

As used herein, to "hydroisomerize" means to convert at least a portion of hydrocarbons to more branched hydrocarbons. An example of hydroisomerization comprises the conversion of linear paraffins into isoparaffins. Another example of hydroisomerization comprises the conversion of monobranched paraffins into dibranched paraffins.

As used herein, to "hydrocrack" generally refers to the breaking down of high molecular weight material into lower molecular weight material. To "hydrocrack" means to split an organic molecule with hydrogen to the resulting molecular fragments to form two smaller organic molecules (e.g., for hydrocracking of n-decane, the exemplary reaction follows: $C_{10}H_{22}+H_2 \rightarrow C_4H_{10}$ and skeletal isomers $+C_6H_{14}$ and skeletal isomers). Because a hydrocracking catalyst can be active in hydroisomerization, there can be some skeletal isomerization during the hydrocracking step, therefore isomers of the smaller hydrocarbons can be formed.

As used herein, the boiling range distribution and specific boiling points for a hydrocarbon stream or fraction within the diesel boiling range or heavier than the diesel boiling range are generally determined by the SimDis method of the American Society for Testing and Materials (ASTM) D2887 *"Boiling Range Distribution of Petroleum Fractions by GC"*, unless otherwise stated. The test method ASTM D2887 is applicable to fractions having a final boiling point of 538° C. (1000° F.) or lower at atmospheric pressure as measured by this test method. This test method is limited to samples having a boiling range greater than 55° C. (100° F.), and having a vapor pressure sufficiently low to permit sampling at ambient temperature. The ASTM D2887 method typically covers the boiling range of the n-paraffins having a number of carbon atoms between about 5 and 44. Further, it should be understood by those of ordinary skill in the art that a fraction or stream of a particular set of hydrocarbons will exhibit a certain identity. The identity will generally be defined as is done herein by boiling point ranges. Other characteristics may set apart a particular fraction's identity as may be discussed herein, e.g., carbon number, degree of isomerization, etc.

As used herein, the boiling range distribution and specific boiling points for a hydrocarbon stream or fraction within the naphtha boiling range or lighter than the naphtha boiling range are generally determined by the ASTM D 86 standard distillation method "*Standard Test Method for Distillation of Petroleum Products at Atmospheric Pressure*", unless otherwise stated.

As used herein, a "diesel" is any hydrocarbon cut having at least a portion, which falls within the diesel boiling range. The diesel boiling range in this application includes hydrocarbons, which boil in the range of about 300° F. to about 750° F. (about 150-400° C.), preferably in the range of about 350° F. to about 650° F. (about 170-350° C.).

As used herein, a "middle distillate" means a hydrocarbon stream which includes kerosene, home heating oil, range oil, stove oil, and diesel that has a 50 percent boiling point in the ASTM D86 standard distillation test falling between 371° F. and 700° F. (about 188-370° C.).

In addition, where words are used interchangeably, e.g., hydroconversion "beds," "zones," and "chambers," or "fractionated," "distilled," and "separated," it is intended that all sets of terms used interchangeably herein individually will have a broader meaning than their ordinary meaning, one that incorporates the full scope of each interchangeable term. Thus, nothing herein should be interpreted as disclaiming or disavowal of a term's scope unless specifically stated as otherwise.

DETAILED DESCRIPTION

There are shown in the Figures, and herein will be described in detail, specific embodiments of the present invention with the understanding that the present disclosure is to be considered an exemplification of the principles of the invention, and is not intended to limit the invention to that illustrated and described herein. The present invention is susceptible to embodiments of different forms or order and should not be interpreted to be limited to the particular methods or compositions contained herein. In particular, various embodiments of the present invention provide a number of different configurations of the overall gas to liquid conversion process.

The present invention is generally related towards enhancing the yield and/or cold-flow properties of certain hydrocarbon products, increasing the degree of isomerization in a diesel product and/or increasing the production rate of a diesel product. Diesel is generally consider to start at about $C_9$ and can extend to about $C_{22}$. The peak of the boiling range is typically around $C_{16}$-$C_{18}$. Depending on the climatic conditions in which the diesel is used, local specifications can allow these limits to be higher or lower. Specifications of diesel fuels will define limits on viscosity, boiling range, density, lubricity, cloud point, pour point, and others. The number of carbon atoms that make up the molecules of a given fuel are a consequence of the tailoring of the fuel to meet those specification requirements. In reality, fuels comprise an array of molecule types.

In a cracking environment, a $C_{30}$ paraffin for example can be hydrocracked into two diesel range paraffinic molecules with smaller numbers of carbon atoms. In an environment where diesel yield is desirable, the $C_{30+}$ paraffin molecule would be cracked once and the cracked diesel range paraffinic molecules would pass immediately to a downstream processing. However, in practicality, at least one of the cracked diesel range paraffinic molecules can be hydrocracked to produce even smaller paraffinic molecules, some of which may no longer be in the diesel boiling range. Hence, secondary cracking tends to reduce the yield of diesel.

Because a hydrocracking process can yield a range of hydrocarbons of differing boiling points, some of which are undesirable, the present invention generally relates to various methods that favor the formation of more desired hydrocarbons and less of the undesirable ones. The methods generally include reducing the residence time of desirable hydrocarbons during hydrocracking, thereby decreasing secondary cracking and increasing isomerization. This is achieved by various hydrocracking configurations, which introduce at least two hydrocarbon feedstreams of different boiling ranges at different entry points in a hydrocracking unit.

In general, the embodiments of the present invention are directed toward using multiple hydrocarbon fractions (having different boiling ranges) that can be introduced at different entry points into a hydrocracking environment. The hydrocracking environment may be comprised of a single hydrocracking bed/chamber, multiple hydrocracking beds/chambers placed in series or in parallel, or a combination thereof. In addition, each hydrocracking bed/chamber may include one or more hydrocracking zones. The differing hydrocarbon fractions are introduced into the different hydrocracking zones. The selection of the hydrocracking arrangement, as well as the selection of the hydrocarbon fractions may be used to achieve certain benefits or end results.

FIG. 1 shows one embodiment of a method for producing liquid hydrocarbon products, which utilizes at least two hydrocracking units operated in parallel. FIG. 1 illustrates a hydroprocessing flow diagram 5 comprising a hydrocarbon stream 8, a fractionator feedstream 10, a fractionator 15, fractionated streams 20, 25, 30, 35, gas exhaust 38, a first hydrocracking unit 40 having at least one hydroconversion zone 45, and a second hydrocracking unit 50 having at least one hydroconversion zone 55.

Fractionator feedstream 10 comprises hydrocarbon stream 8 and a hydroconverted recycling stream 70. In general terms, hydrocarbon stream 8 preferably comprises $C_{5+}$ hydrocarbons from a hydrocarbon synthesis reactor (not shown). Suitable hydrocarbon synthesis reactors will be discussed in more detail below. A preferred hydrocarbon synthesis reactor comprises a Fischer-Tropsch synthesis reactor.

Hydrocarbon stream 8 preferably comprises primarily $C_{5+}$ hydrocarbons, some of which are saturated hydrocarbons (i.e., have no unsaturated carbon-carbon bonds) such as paraffins, and some of which are unsaturated hydrocarbons (i.e., have unsaturated carbon-carbon bonds) such as alkenes (also called olefins). Hydrocarbon stream 8 should contain at least 70% by weight of $C_{5+}$ linear paraffins, preferably at least 75% by weight of $C_{5+}$ linear paraffins; more preferably at least 85% by weight of $C_{5+}$ linear paraffins. Hydrocarbon stream 8 could contain up to 15% by weight of olefins. Hydrocarbon stream 8 may also comprise. heteroatomic compounds such as sulfur-containing compounds (e.g., sulfides, thiophenes, benzothiophenes, and the like); nitrogen-containing compounds (e.g., amines, ammonia); and oxygenated hydrocarbons also called oxygenates (e.g., alcohols, aldehydes, esters, aldols, ketones, and the like). Hydrocarbon stream 8 could contain up to 10% by weight of oxygenates, but more typically between about 0.5% and about 5% by weight of oxygenates. Hydrocarbon stream 8 also typically contains less than 0.1% by weight of sulfur-containing and nitrogen-containing compounds. Hydrocarbon stream 8 comprising $C_{5+}$ hydrocarbon products from a hydrocarbon synthesis reactor may be hydrotreated prior to being fed to fractionator 15. If hydrocarbon stream 8 is hydrotreated prior to being fed to fractionator 15, hydrocarbon stream 8 should contain at least 90% by weight of $C_{5+}$ linear paraffins, preferably at least 95% by weight of $C_{5+}$ linear paraffins. Fractionator feedstream 10 may further comprise some other hydrocarbon source such as derived from crude oils, shale oils, and/or tar sands.

Fractionator feedstream 10 is introduced into fractionator 15 to be separated into at least a heavier fraction 30 and a lighter fraction 25. It should be understood that for purposes of this disclosure and unless described otherwise, "heavier" and "lighter" are intended to denote the boiling point range of the fraction. The terms are also intended to mean heavier or lighter relative to each other. For example, the heavier fraction is intended to mean that the boiling range of the heavier fraction is higher than that of the lighter fraction. Like the embodiments described later in association with FIGS. 2-5, it will be understood by one of ordinary skill in this art that the heavier and lighter fractions comprise mixtures of a vast number of actual constituents with various numbers of carbon atoms. Each of fractions 20 and 35 may be one or more streams and are merely representative in FIG. 1 of products from fractionator 15 that are generally "lighter" than fraction 25 or are simply not used in the hydroprocessing scheme 5 depicted and described herein. In reality, fraction 20 represents at least a portion of desired diesel products and fraction 35 represents at least a portion of a naphtha stream from the hydroprocessing embodiment 5 of the present invention. Any light hydrocarbons with less than 5 carbon atoms created in hydrocracking units 40 and 50 and/or passing through fractionator 15 may exit via exhaust 38. Water can also exit fractionator 15 primarily via fraction 35, and may sometimes be present in exhaust 38.

The heavier fraction 30 preferably comprises hydrocarbons with a boiling range comprising a 5% boiling point equal to or greater than 640° F. The lighter fraction 25 should comprise hydrocarbons with a boiling range comprising a 5% boiling point equal to or greater than about 350° F. and a 95% boiling point less than, equal to, or up to about 150° F. greater than the initial boiling point of the heavier fraction 30. Although not specified above, it will be understood by one of ordinary skill in this art that the heavier and lighter fractions 30 and 25 may be comprised of a vast number of actual constituents. For example, in one embodiment, the heavier fraction 30 may have a boiling range comprising a 5% boiling point of about 800° F. (representing hydrocarbons with about 30 or more carbon atoms or "$C_{30+}$ hydrocarbons"). The lighter fraction 25 may have a boiling range comprising a 5% boiling point of about 570° F. and a 95% boiling point of about 800° F. (representing hydrocarbons with about 15 to 30 carbon atoms or "$C_{15}$-$C_{30}$ hydrocarbons"); or a boiling range comprising a 5% boiling point of about 640° F. and a 95% boiling point of about 800° F. (representing hydrocarbons with about 20 to 30 carbon atoms or "$C_{20}$-$C_{30}$ hydrocarbons"); or a boiling range comprising a 5% boiling point of about 570° F. and a 95% boiling point of about 730° F. (representing hydrocarbons with about 15 to 25 carbon atoms or "$C_{15}$-$C_{25}$ hydrocarbons"). In another embodiment, the heavier fraction 30 may have a boiling range comprising a 5% boiling point of about 640° F. (representing hydrocarbons with more than about 20 carbon atoms or "$C_{20+}$ hydrocarbons"). The lighter fraction 25 may have a boiling range comprising a 5% boiling point of about 570° F. and a 95% boiling point of about 640° F. (representing hydrocarbons with about 15 to 20carbon atoms or "$C_{15}$-$C_{20}$ hydrocarbons"); or a boiling range comprising a 5% boiling point of about 380° F. and a 95% boiling point of about 640° F. (representing hydrocarbons with about 10 to 20 carbon atoms or "$C_{10}$-$C_{20}$ hydrocarbons"); or a boiling range comprising a 5% boiling point of about 580° F. and a 95% boiling point of about 800° F. (representing hydrocarbons with about 15 to 30 carbon atoms or "$C_{15}$-$C_{30}$ hydrocarbons"). All of these more specific embodiments, as well as others, are within the scope of the present invention.

It should be understood by those of ordinary skill in the art that producing a fraction with a definite cutoff, e.g., 30 carbon atoms, is generally very difficult and expensive, although not impossible. The reality, especially in industrial settings, is that a distillation process targeting a cutoff of a specified carbon number or temperature will still contain a small amount of material above or below the target that becomes entrained into the fraction for various reasons. For example, no two fractions of "diesel" are exactly the same, however, it still is designated and sold as "diesel." It is therefore intended that these explicitly specified fractions may contain a small amount of other material. The amount outside the targeted range will generally be determined by how much time and expense the user is willing to expend and/or by the limitations of the type of fractionation technique or equipment available.

The heavier fraction 30 is fed into hydrocracking unit 40 where some of the components of heavier fraction 30 are hydroconverted under hydrocracking promoting conditions, i.e., the carbon chain length of these hydroconverted components is decreased, to produce a first hydroconverted effluent stream 60. A portion 62 of the first hydroconverted effluent stream 60 may be fed into the second hydroconversion zone 50 (configuration shown). Another portion 64 is fed into fractionator feedstream 10 via recycle line 70 (configuration shown by a dotted line) or fed directly into fractionator 15 (configuration not shown).

A portion 26 of lighter fraction 25 and a portion 62 of first hydroconverted effluent 60 are fed to the second hydroconversion unit 50. While hydrocarbons from lighter fraction 25 and portion 62 of effluent 60 pass through hydroconversion zone 55, some of them are hydroconverted in the presence of hydrogen to form a second hydroconverted effluent stream 65. Second hydroconverted effluent stream 65 and portion 64 of first effluent stream 60 may be fed, either separately (not shown) or combined (as shown in recycle line 70), into fractionator feedstream 10. Alternatively, second effluent stream 65 and portion 64 of first effluent stream 60 may be fed directly into fractionator 15 (configuration not shown). Another portion 28 of lighter fraction 25, not sent to second hydroconversion unit 50, can be blended with fraction 20 to form a diesel product 29 (illustrated in dotted line). Alternatively, substantially all of lighter fraction 25 can be sent to second hydroconversion unit 50, and fraction 20 comprises a full-boiling range diesel product.

Each of the zones 45 and 55 may be contained within a single vessel within their respective hydrocracking units 40 and 50. In addition, it is within the scope of the invention that each hydrocracking unit may comprise separate vessels or physical structures, each housing one or more hydroconversion zones (this configuration is not shown).

The method also includes introducing hydrogen gas into the hydrocracking units 40 and 50, so that the hydrogen gas flows through each of the hydrocracking zones 45 and 55 and over the catalyst present in each of the two hydrocracking zones 45 and 55. The flowing hydrogen should contact the catalyst in hydrocracking zones 45 and 55, so as to favor reaction between hydrocarbons and hydrogen. A portion of the hydrogen feed may be distributed via a distribution zone upstream of each hydroconversion zone 45 and 55 as a separate hydrogen feed to each of the hydroconversion zones 45 and 55 is preferred. There may be some unconsumed hydrogen from portion 62 of hydroconverted effluent 60 fed to second hydrocracking unit 50, which is carried-over to hydroconversion zone 55.

Each hydroconversion zone 45 and 55 may experience an increase in temperature from upstream to downstream as the hydrocarbons pass through each zone and react with hydrogen over the catalyst present in each zone. However, since the catalytic hydrocracking reaction of highly paraffinic stream is not as exothermic as that of aromatic-containing stream, the temperature rise is not so significant in the hydroconversion zones 45 and 55, thus a quench is not required to cool along each of the hydroconversion zone. The temperature at the feedstream entry point of each hydroconversion zone 45 and 55 could be adjusted by careful control of the temperature of their respective feedstreams. The temperature at the feedstream entry point of the second hydroconversion zone 55 may be equal to or greater than about that of the temperature of portion 62 of hydroconverted effluent 60 from first hydroconverted zone 45 and the temperature of portion 26 of the light fraction 25. In other words, neither of portion 26 of the light fraction 25 and portion 62 of the first hydroconverted effluent 60 are used as quenching fluids for the second hydroconversion zone 55. Hence, passing portion 26 of the light fraction 25 and portion 62 of the first hydroconverted effluent 60 to second zone 55 does not quench the hydroconversion reaction taking place in second zone 55.

Preferably, each of hydroconversion zones 45 and 50 comprises at least one hydrocracking catalyst. The hydrocracking catalyst in each zone should comprise a hydrogenation component and a cracking component (typically an acid component). The hydrogenation component may include a metal selected from the group consisting of platinum (Pt), palladium (Pd), nickel (Ni), cobalt (Co), tungsten (W), molybdenum (Mo), and combinations thereof. The hydrogenation component in the hydrocracking catalysts preferably includes Pt, Pd, or combination thereof The cracking component for the hydrocracking catalyst in hydroconversion zone 45 may be an amorphous cracking material and/or a molecular sieve material. A preferred cracking component comprises an amorphous silica-alumina; however Y-type zeolite, SAPO-type molecular sieves (−11; −31; −37; −41), ZSM-type zeolites (−5; −11; −48), and dealuminated zeolites may also be used. The cracking component may support the hydrogenation component; however the catalyst may further comprise a binder, which supports both hydrogenation component and cracking component. If, for example, more hydroisomerization is desirable in hydroconversion zone 55, the hydrocracking catalyst in the hydroconversion zone 55 could comprise a less acidic cracking component.

The first hydroconversion zone 45 may comprise a hydrocracking catalyst bed, and the second hydroconversion zone 55 may comprise a bifunctional catalyst bed and suitable conversion promoting conditions for hydrocracking, hydroisomerization, dewaxing, or combinations thereof. This hydrocracking arrangement should increase the degree of isomerization in the effluent 65 of hydrocracking unit 50.

In addition, the size of hydrocracking unit 50 is expected to be smaller than the size of hydrocracking unit 40. Indeed, the hydrocarbon feed rate to hydrocracking unit 40 should be at least two times greater than the hydrocarbon feed rate to hydrocracking unit 50. Typically, the mass flow rate of light fraction 25 represents less than about 30% of the mass flow rate of heavy fraction 30, preferably less than about 20% of the mass flow rate of heavy fraction 30. Typically, the mass flow rate f portion 64 of first hydroconverted effluent 60, being fed to the second hydrocracking unit 50, represents less than about 60% of the mass flow rate of first hydroconverted effluent 60, preferably less than about 40% of the mass flow rate of first hydroconverted effluent 60.

In some embodiments, when light fraction 25 comprises a heavy diesel product ($C_{15}$-$C_{20}$ or $C_{16}$-$C_{22}$), portion 26 of light fraction 25 would represent less than 50%, preferably less than 30% of light fraction 25. Alternatively, when light fraction 25 comprises a light wax ($C_{20}$-$C_{25}$ or $C_{20}$-$C_{30}$), portion 26 of light fraction 25 could represent substantially all of light fraction 25 (i.e., more than 90%).

The conversion promoting conditions in both hydroconversion zones 45 and 55 are preferably at a temperature of about 500° F. to about 750° F. (260-400° C.) and at a pressure of about 500 psig to about 1500 psig (3,550-10,440 kPa), an overall hydrogen consumption of 200-10,000 standard cubic feet per barrel of hydrocarbon feed or scf $H_2$/bbl HC [about 35-1,800 STP $m^3$ $H_2/m^3$ HC feed], preferably 200-2,000 scf $H_2$/bbl HC, more preferably 250-500 scf $H_2$/bbl HC using a liquid hourly space velocities based on the hydrocarbon feedstock of about 0.1 to about 10 $hr^{-1}$, preferably between 0.25 to 5 $hr^{-1}$. In some embodiments, the average temperature in hydroconversion zone 55 may be lower than that of hydroconversion zone 45, in order to decrease the severity of the hydrocracking and to favor hydroisomerization instead. In alternate embodiments, the average temperature in hydroconversion zone 55 is about the same as in hydroconversion zone 45 or slightly higher than that of hydroconversion zone 45.

In a preferred embodiment, hydrocracking in zones 45 and 55 takes place over a platinum or palladium catalyst preferably supported on a structured silica-alumina material such as a zeolite (i.e., ZSM-5) or an amorphous silica-alumina at a temperature of about 500° F. to about 750° F. (260-400° C.) and at a pressure of about 500 psig to about 1500 psig (3,550-10,440 kPa), with a hydrogen flow between about 200 standard cubic feet of hydrogen per barrel of hydrocarbon feed and about 1,000 scf $H_2$/bbl HC.

Figure 2:
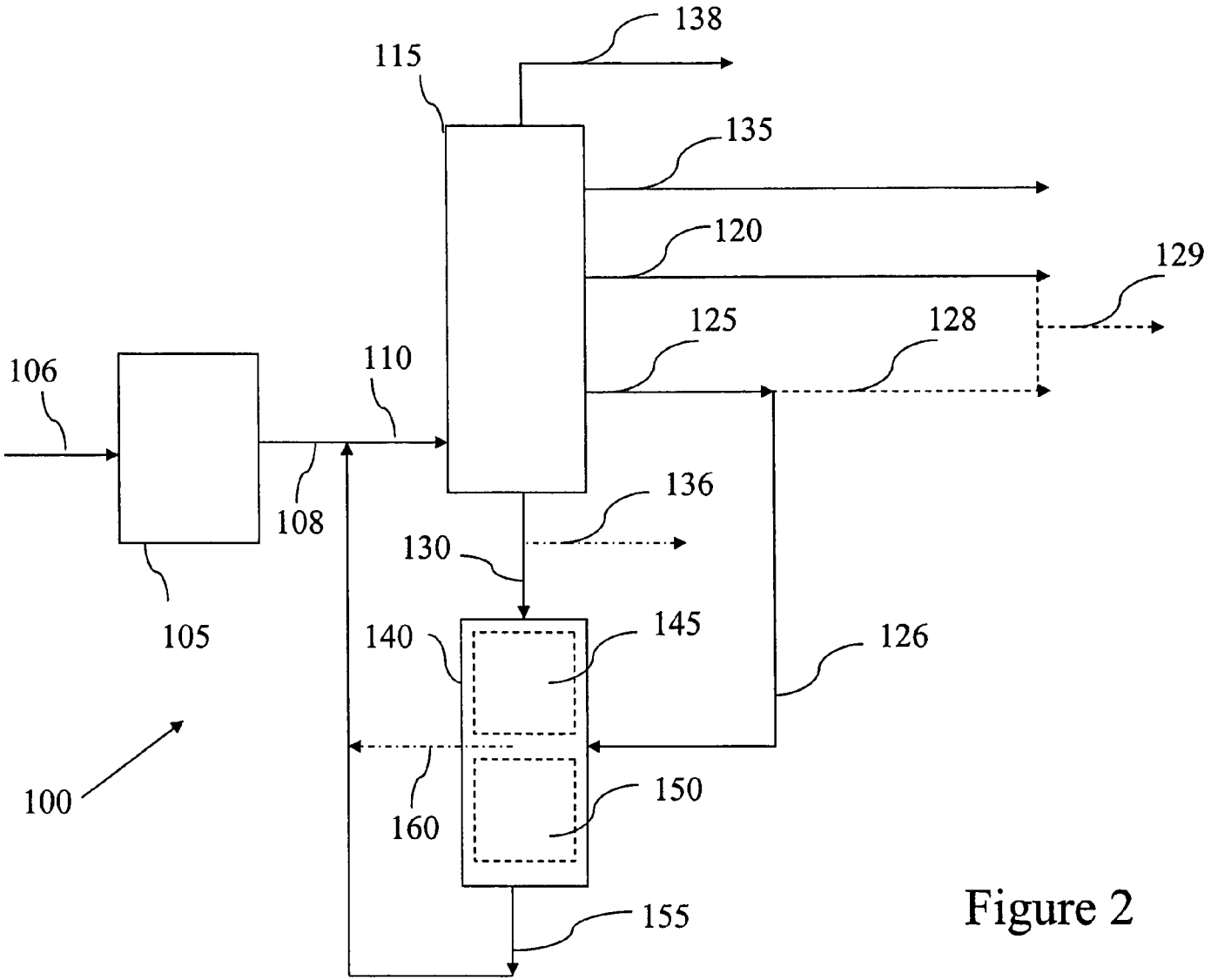
FIG. 2 shows a flow diagram having two hydrocracking zones in series fed by two hydrocarbon feed streams and an optional hydrotreater upstream of said hydrocracking zones in accordance with at least one embodiment of the invention.

In one preferred embodiment illustrated in FIG. 2, the invention discloses a method for creating a more branched highly paraffinic fuel with acceptable cold flow property, wherein a significant portion of said fuel comprises hydrocarbons derived from a Fischer-Tropsch synthesis. The method employs a fractionating step, and a hydrocracking/hydroisomerization step comprising at least two hydroconversion zones operated in series. The method may further employ a hydrotreating step. The optional hydrotreating step may be performed on the hydrocarbon feedstream to the hydrotreater prior to the fractionation, such that hydrotreated hydrocarbon fractions serve as separate feedstocks to the multiple hydroconversion zones. Alternatively, the fractions serving as separate feedstocks to the multiple hydrocracking zones could be individually hydrotreated before being fed to the appropriate hydroconversion zones. However, when a hydrotreatment step is used upstream of the hydrocracking/hydroisomerization zones, it is preferred that a liquid hydrocarbon stream comprising hydrocarbons with at least 5 or more carbon atoms ($C_{5+}$ hydrocarbons) is hydrotreated, and then, the hydrotreated $C_{5+}$ hydrocarbons stream is fed to a fractionator to generate at least one heavier hydrotreated fraction and one lighter hydrotreated fraction which serve as separate feedstocks to the hydroconversion zones. Preferably, the liquid hydrocarbon stream sent to a hydrotreating zone comprises a majority of $C_{5+}$ hydrocarbon products from a Fischer-Tropsch synthesis.

FIG. 2 shows a hydroprocessing flow diagram 100 for producing liquid hydrocarbon products comprising a hydrotreator 105, a fractionator feedstream 110, a fractionator 115, fractions 120, 125, 130, 135, gas exhaust 138, and a hydrocracking unit 140 having at least two hydroconversion zones 145 and 150, wherein hydroconversion zone 150 is located downstream of hydroconversion zone 145, and a hydroconverted effluent stream 155.

Using the process scheme depicted in FIG. 2, a liquid hydrocarbon stream 106 is optionally passed through hydrotreater 105 to form a hydrotreated hydrocarbon stream 108. Hydrotreated hydrocarbon stream 108 is optionally mixed with hydroconverted effluent stream 155 to form fractionator feedstream 110, which is then separated by difference in boiling points into fractions 120, 125, 130, 135, and gas exhaust 138. Substantially all of fraction 130 and at least a portion 126 of fraction 125 are fed to the hydrocracking unit 140 at different locations so as to generate hydroconverted effluent stream 155. Hydroconverted effluent stream 155 is then recycled to fractionator 110, either by being combined with hydrotreated hydrocarbon stream 108 (as shown) or by being fed separately to fractionator 115 (not shown).

The source of the liquid hydrocarbon stream 106 is not critical for the present invention; however, in a preferred embodiment, the liquid hydrocarbon stream 106 includes hydrocarbon products with at least 5 or more carbon atoms ($C_{5+}$ hydrocarbons) generated in a hydrocarbon synthesis reactor (not shown). Suitable hydrocarbon synthesis reactors will be discussed in more detail below. A preferred hydrocarbon synthesis reactor comprises a Fischer-Tropsch synthesis reactor.

Liquid hydrocarbon stream 106 may further contain hydrocarbons from other sources, for examples hydrocarbons from crude oil refining, or from processing of shale oils and/or tar sands. For example, Fischer-Tropsch $C_{5+}$ hydrocarbon products can be combined with one or more light boiling range fractions obtained from a distillation of crude oil and/or with one or more heavy boiling range fractions obtained from vacuum distillation, deoiling and dewaxing processes or from processing of shale oils or tar sands, in order to form liquid hydrocarbon stream 106.

Liquid hydrocarbon stream 106 should comprise primarily $C_{5+}$ hydrocarbons, some of which are saturated hydrocarbons (i.e., have no unsaturated carbon-carbon bonds) such as alkanes and paraffins, and some of which are unsaturated hydrocarbons (i.e., have unsaturated carbon-carbon bonds) such as alkenes (also called olefins). Liquid hydrocarbon stream 106 should contain at least 70% by weight of $C_{5+}$ linear paraffins, preferably at least 75% by weight of $C_{5+}$ linear paraffins; more preferably at least 85% by weight of $C_{5+}$ linear paraffins. Liquid hydrocarbon stream 106 could contain up to 25% by weight of olefins, preferably up to 15% by weight of olefins; more preferably up to 10% by weight of olefins. Liquid hydrocarbon stream 106 may also comprise some cyclic compounds such as aromatics, but its aromatic content is typically less than 1%. Liquid hydrocarbon stream 106 may also comprise. heteroatomic compounds such as sulfur-containing compounds (e.g., sulfides, thiophen, benzothiophenes, and the like); nitrogen-containing compounds (e.g., amines, ammonia); and oxygenated hydrocarbons also called oxygenates (e.g., alcohols, aldehydes, esters, ketones, and the like). Liquid hydrocarbon stream 106 could contain up to 10% by weight of oxygenates, preferably up to 5% by weight of oxygenates, but contains typically less than 0.1 percent by weight of sulfur-containing and nitrogen-containing compounds. Liquid hydrocarbon stream 106 may further comprise some solid material. The solid material in liquid hydrocarbon stream 106 could comprise catalyst particles, particularly when at least a portion of the liquid hydrocarbon stream 106 is derived from a hydrocarbon synthesis reactor employing free-flowing or suspended catalyst particles for promoting the synthesis.

Liquid hydrocarbon stream 106 is passed through an optional hydrotreater 105 under hydrotreating promoting conditions so as to convert unsaturated hydrocarbons to saturated hydrocarbons and remove at least a portion of, or substantially all of, heteroatoms (such as sulfur, oxygen, and nitrogen) from heteoatomic compounds which may be present in liquid hydrocarbon stream 106.

It is preferred that the hydrotreating in optional hydrotreater 105 removes substantially all olefins. Olefins are known to cause chemical instability in diesel fuel. This instability frequently manifests itself in the formation of gums, which may form solid deposits in the fuel system and engine. This instability is typically measured by the oxidation stability ASTM D2274 test. Moreover, the hydrotreating conditions should be selected to remove substantially all of the oxygen atoms from oxygenates present in the liquid hydrocarbon stream 106, or to remove only a portion of oxygen atoms from the oxygenates. Oxygenates (particularly alcohols) derived from Fischer-Tropsch synthesis have shown to advantageously increase the lubricity of a diesel product provided by Fischer-Tropsch synthesis.

Hydrotreating in optional hydrotreater 105 may comprise mild hydrotreating conditions. A mild hydrotreatment would have the benefits of converting substantially all unsaturated hydrocarbons to saturated hydrocarbons, removing a substantial portion or all of the heteroatoms from the heteroatomic compounds present in the hydrocarbon stream, and optionally also capturing most of the solid material. The mild hydrotreatment may be performed over a hydrotreating catalyst comprising at least one metal from the group consisting of Ni, Co, Pd, Pt, Mo, W, Cu—Cr combinations, Cu—Zn combinations, and Ru, preferably comprising Ni, Co, Mo, W or combinations thereof, more preferably comprising Ni, over at temperatures above 300° F. (about 150° C.), preferably from 350° F. to about 600° F. (about 170-315° C.), more preferably from 360° F. to about 600° F. (about 180-315° C.), with a hydrogen partial pressure in the outlet of hydrotreater 105 between about 100 psia and about 2,000 psia (about 690-13,800 kPa).

Hydrotreating in optional hydrotreater 105 may comprise "ultra-low severity" hydrotreating conditions. A "ultra-low severity" hydrotreatment is used to remove only a portion of the oxygen atoms from the oxygenates present in the liquid hydrocarbon stream 106, while removing substantially all of the olefins in said hydrocarbon stream 106, such that the hydrotreated stream 108 may comprise some oxygenates, but is substantially free of olefins. The Applicants believe that an "ultra-low severity" hydrotreatment step of the liquid hydrocarbon stream 106, which comprises primarily Fischer-Tropsch $C_{5+}$ hydrocarbon products may be desirable to increase the lubricity of diesel product obtained therein. Two of the most important factors in determining whether a hydrotreating unit employs "ultra-low severity" conditions are catalyst composition and temperature. "Ultra-low severity" hydrotreating can take place with a hydrotreating catalyst comprising at least one of the following metals: a metal from Group 6 (new IUPAC notation), such as molybdenum (Mo) and tungsten (W), or a metal from Groups 8, 9, and 10 of the Periodic Table (new Notation as found in, for example, the CRC Handbook of Chemistry and Physics, 82nd Edition, 2001-2002, and used throughout this specification), such as nickel (Ni), palladium (Pd), platinum (Pt), ruthenium (Ru), iron (Fe), and/or cobalt (Co), or combinations thereof. Highly active catalysts, such as those comprising Ni, Pd, Pt, W, Mo, Ru or combinations thereof, must be operated at relatively low temperatures (to maintain ultra-low severity hydrotreating conditions) between about 180° F. and about 350° F. (about 80-180° C.), more preferably between about 180° F. and about 320° F. (about 80-160° C.), still more preferably between about 180° F. to about 300° F. (about 80-150° C.). By way of example only, a highly active hydrotreating catalyst, such as a nickel-based hydrotreating catalyst, begins to convert a substantial amount of oxygenates to paraffins at about 250° F. In contrast, less active hydrotreating catalysts, such as those comprising Fe or Co, do not begin to convert oxygenates until a temperature of about 350° F. is reached. For these less-active catalysts with lower hydrotreating activity (e.g., with Co or Fe), a preferred temperature range for "ultra-low severity" hydrotreating is between about 350° F. and about 570° F. (about 180-300° C.). Additionally, there are other parameters such as for example, pressure and liquid hourly space velocity, which may be varied by one person of ordinary skill in the art to effect the desired "ultra-low severity" hydrotreating. Preferably the hydrogen partial pressure is between about 100 psia and about 1,000 psia (690-6900 kPa), more preferably between about 300 psia and about 500 psia (2060-3450 kPa). The liquid hourly space velocity is preferably between 1 and 10 $hr^{-1}$, more preferably between 0.5 and 6 $hr^{-1}$, still more preferably between about 1 and about 5 $hr^{-1}$. It should be understood that the hydrotreating catalyst for "ultra-low severity" hydrotreatment can be with or without support, although is preferably supported, and can comprise promoters to improve catalyst performance and/or support structural integrity.

Advantageously, regardless of hydrotreatment conditions used for the hydrotreating of liquid hydrocarbon stream 106, hydrotreating in hydrotreater 105 can also remove or reduce solid material that may be present in the liquid hydrocarbon stream 106. It is expected that, if the hydrocracking feedstreams are not hydrotreated prior to entering a hydroconversion zone in hydrocracking unit 140, the presence of heteroatomic compounds and of solid material in these hydrocracking feedstreams could reduce the performance of the hydrocracking unit. Indeed, sulfur is a known poison of hydrocracking catalysts. Solid material depositing on top of and/or embedding in a hydroconversion zone comprising a fixed catalytic bed increases the pressure drop across that catalytic bed. Even though a hydrotreating zone comprising a catalytic bed would suffer similar disadvantages from heteroatomic compounds and solid material, a hydrotreating catalyst (such as comprising Ni and/or Co) is typically less sensitive to poisoning from heteoatomic compounds than a hydrocracking catalyst (comprising Pt and/or Pd). Moreover, typical hydrotreating catalysts use cheaper hydrogenation metals (Co and/or Ni) and hence are less costly than hydrocracking catalysts comprising at least one expensive precious metal (such as Pt or Pd). Therefore, using larger catalytic bed volume and/or replacing more frequently the hydrogenation catalyst are more cost-effective options for a hydrotreating unit than for a hydrocracking unit. Therefore the removal of heteroatoms from heteroatomic compounds as well as solid material in a hydrotreating zone prior to hydrocracking may result in a more-cost effective hydroprocessing scheme 100. Yet, the hydrotreating step of the feedstream for the hydrocracking/hydroisomerization zones may not be performed prior to the hydrocracking step. A hydrotreating step could be omitted. Or a hydrotreating step could be performed after the hydrocracking step, and optionally, at least a portion of the hydrocracked product stream could be hydrotreated prior to being fed to the fractionator. However, not hydrotreating prior to hydrocracking would result in at least one of following shortfalls: a) in shortening the operating lifetime of the expensive hydrocracking catalyst(s) present in the various hydrocracking zones; b) in decreasing the hydrocracking performance; or c) in increasing the hydrogen need of at least the first hydrocracking zone. Thus, the benefits would have to be measured against the possible shortfalls on a case-by-case basis. Removing most of the solid material and some of heteroatoms which may be present in the hydrocarbon stream 106 should benefit the downstream hydrocracking step performed in unit 140, especially by minimizing the possible negative impact from said heteroatoms and/or solid material on the hydrocracking performance and hydrocracking catalyst longevity.

Hydrotreating of liquid hydrocarbon stream 106 in hydrotreater 105 results in obtaining a hydrotreated hydrocarbon stream 108. Hydrotreated hydrocarbon stream 108 should comprise a substantial portion of saturated hydrocarbons. If hydrocarbon stream 108 is hydrotreated prior to being fed to fractionator 115, hydrocarbon stream 108 should contain at least 90% by weight of $C_{5+}$ linear paraffins, preferably at least 95% by weight of $C_{5+}$ linear paraffins. Hydrotreated hydrocarbon stream 108 should be substantially free of solid material (i.e., less than 50 ppm solid). In addition, hydrotreated hydrocarbon stream 108 may comprise some oxygenates (preferably not more than about 2%)if the hydrotreatment step employs "ultra-low severity" conditions. Alternatively, hydrotreated hydrocarbon stream 108 could be substantially free of oxygenates, substantially free of sulfur-containing compounds, substantially free of nitrogen-containing compounds, i.e., wherein "substantially free" means less than 50 ppm of each heteroatom selected from O, S or N. Finally, hydrotreated hydrocarbon stream 108 can also include water.

Fractionator feedstream 110 comprises hydrotreated hydrocarbon stream 108 and optionally hydroconverted effluent stream 155 (as shown in FIG. 2). When hydroconverted effluent stream 155 is fed separately to fractionator 115, fractionator feedstream 110 comprises primarily hydrotreated hydrocarbon stream 108. Although not shown, fractionator feedstream 110 may further comprise hydrocarbons from other sources (other than a Fischer-Tropsch synthesis), it is preferred that the hydrocarbons from these alternate sources undergo hydrotreatment before being introduced to fractionator 115, to convert substantially all of the unsaturated hydrocarbons to saturated hydrocarbons and remove some or most of heteroatoms in heretoatomic compounds present in these other hydrocarbon sources.

Fractionator feedstream 110 is fed to fractionator 115 in order for its components to be separated based on their boiling point, so as to generate various hydrocarbon fractions of different boiling ranges. The type of fractionator is not critical to the present invention and can comprise any fractionator technology and/or methods known in the art. One of ordinary skill in the art will readily understand the types of fractionators useful for separating liquid hydrocarbons of this nature into the various fractions described herein. For ease of discussion, and without any intention to be so limited, fractionator 115 can comprise a standard atmospheric fractional distillation apparatus. Accordingly, fractionator feedstream 110 is separated into at least two fractions. For example, fractionator feedstream 110 may be separated into a heavier fraction 130 and a lighter fraction 125, such that the heavier fraction 130 and portions (or all) of the lighter fraction 125 serve as feedstreams to hydrocracking unit 140.

The heavier fraction 130 preferably comprises hydrocarbons with a boiling range comprising a 5% boiling point equal to or greater than about 640° F. The lighter fraction 125 should comprise hydrocarbons with a boiling range comprising a 5% boiling point equal to or greater than about 350° F. and a 95% boiling point less than, equal to, or up to 150° F. greater than the 5% boiling point of the heavier fraction 130. Although not specified above, it will be understood by one of ordinary skill in this art that the heavier and lighter fractions 130 and 125 may be comprised of a vast number of actual constituents. For example, in one embodiment, the heavier fraction 130 may have a boiling range comprising a 5% boiling point of about 800° F. (representing hydrocarbons with about 30 or more carbon atoms or "$C_{30+}$ hydrocarbons"). The lighter fraction 125 may have a boiling range comprising a 5% boiling point of about 570° F. and a 95% boiling point of about 800° F. (representing hydrocarbons with about 15 to 30 carbon atoms or "$C_{15}$-$C_{30}$ hydrocarbons"); or a boiling range comprising a 5% boiling point of about 640° F. and a 95% boiling point of about 800° F. (representing hydrocarbons with about 20 to 30 carbon atoms or "$C_{20}$-$C_{30}$ hydrocarbons"); or a boiling range comprising a 5% boiling point of about 570° F. and a 95% boiling point of about 730° F. (representing hydrocarbons with about 15 to 25 carbon atoms or "$C_{15}$-$C_{25}$ hydrocarbons"). In another embodiment, the heavier fraction 130 may have a boiling range comprising a 5% boiling point of about 640° F. (representing hydrocarbons with more than about 20 carbon atoms or "$C_{20+}$ hydrocarbons"). The lighter fraction 125 may have a boiling range comprising a 5% boiling point of about 570° F. and a 95% boiling point of about 640° F. (representing hydrocarbons with about 15 to 20 carbon atoms or "$C_{15}$-$C_{20}$ hydrocarbons"); or a boiling range comprising a 5% boiling point of about 380° F. and a 95% boiling point of about 640° F. (representing hydrocarbons with about 10 to 20 carbon atoms or "$C_{10}$-$C_{20}$ hydrocarbons"); or a boiling range comprising a 5% boiling point of about 580° F. and a 95% boiling point of about 800° F. (representing hydrocarbons with about 15 to 30 carbon atoms or "$C_{15}$-$C_{30}$ hydrocarbons"). All of these more specific embodiments, as well as others, are within the scope of the present invention.

The fractionation of optionally-hydrotreated fractionator feedstream 110 preferably results in generating more than two fractions, e.g., a middle distillate fraction 120, an intermediate distillate fraction 125, a waxy fraction 130, a naphtha fraction 135, and a gas exhaust 138, wherein the intermediate fraction 125 has a 5% boiling point greater than that of middle distillate fraction 120, and a 5% boiling point lower than that of waxy fraction 130. Each of fractions 120 and 135 may be one or more separate streams and is merely representative in FIG. 2 of products from fractionator 115 that are generally "lighter" than fraction 125 or are simply not used in the hydroprocessing scheme depicted and described herein. Stated differently, the embodiment shown in FIG. 2 includes additional fractions 120 and 135 as mere illustration. In reality, there may be more factions or the two may be a single combined fraction. Fractions 120 and 135 represent at least a portion of desired diesel and naphtha products, respectively, from the hydroprocessing embodiments of the present invention. Any gaseous hydrocarbon with not more than 5 carbon atoms ("$C_{5-}$ hydrocarbons") formed in hydrocracking unit 40 or passing through fractionator 115 may exit via exhaust 138. Water also is collected mostly in naphtha fraction 135.

In one preferred embodiment, fractionator 115 comprises an atmospheric distillation column. In this embodiment, as a non-limiting example, middle distillate fraction 120 preferably comprises a light diesel (representing hydrocarbons with about 9 up to 15 carbon atoms, such as comprising $C_9$-$C_{12}$ or $C_9$-$C_{15}$ or $C_{10}$-$C_{15}$ hydrocarbons); intermediate fraction 125 preferably comprises a heavy diesel (representing hydrocarbons with about 12 up to 22 carbon atoms, such as comprising $C_{12}$- $C_{20}$ or $C_{12}$-$C_{22}$ or $C_{15}$-$C_{22}$ hydrocarbons), wherein fraction 125 has a higher boiling range than fraction 120; waxy fraction 130 comprises hydrocarbon wax (i.e., $C_{20+}$ hydrocarbons); naphtha fraction 135 comprises a naphtha (such as comprising $C_5$-$C_{10}$ or $C_5$-$C_9$ hydrocarbons) and some water; and gas exhaust 138 comprises hydrocarbons with 4 or less carbon atoms ($C_{5-}$ hydrocarbons), and may include small amounts of water.

In one other embodiment, separating by fractionation hydrocarbon stream 108 comprises generating at least i) a wax fraction 130 comprising a boiling range with a 5% boiling point $T_H$, wherein $T_H$ is equal to or greater than about 640° F.;

ii) an intermediate fraction 125 comprising a boiling range with a 5% boiling point $T_I$ and a 95% boiling point $T_J$, wherein $T_J$ is between about $T_H$−100° F. and $T_H$+150° F., and wherein $T_I$ is between about 500° F. and $T_J$−50° F.; and;

iii) a middle distillate fraction 120 comprising a boiling range with a 5% boiling point between about 330° F. and about 350° F., and a 95% boiling point $T_k$, wherein $T_k$ is between about $T_I$−50° F. and $T_I$+50° F., if $T_I$ is less than about 640° F., or $T_k$ is equal to about 640° F. if $T_I$ is greater than 640° F.

The method further includes reacting the wax fraction 130 over a catalyst in a first hydroconversion reaction zone under hydrocracking promoting conditions so as to form a first hydroconverted effluent; passing the first hydroconverted effluent and at least a portion of intermediate fraction 125 in a second hydroconversion reaction zone under hydrocracking promoting conditions so as to form a second hydroconverted effluent; and feeding said second hydroconverted effluent to the fractionator 105, wherein a diesel product 129 is formed and comprises at least the middle distillate fraction 120 and optionally a portion 128 of the intermediate fraction 125 if $T_J$ is less than about 640° F. In some embodiments, $T_H$ is about equal to about 640° F.; $T_J$ is about equal to about 640° F.; $T_I$ is between about 400° F. and about 600 ° F.; and $T_k$ is equal to about $T_I$. In alternate embodiments, $T_H$ is about equal to about 640° F.; $T_J$ is between about 550° F. and about 800° F.; $T_I$ is between about 400° F. and about $T_J$–50° F.; and $T_k$ is equal to about $T_I$. In yet other embodiments, $T_H$ is equal to about 800° F.; $T_J$ is between about 700° F. and about 850° F.; $T_I$ is between about 640° F. and about $T_J$–50° F.; and $T_k$ is equal to about 640° F. In yet other embodiments, $T_H$ is about equal to about 900° F.; $T_J$ is between about 700° F. and about 900° F.; $T_I$ is between about 640° F. and about $T_J$–50° F.; and $T_k$ is equal to about 640° F.

Figure 3:
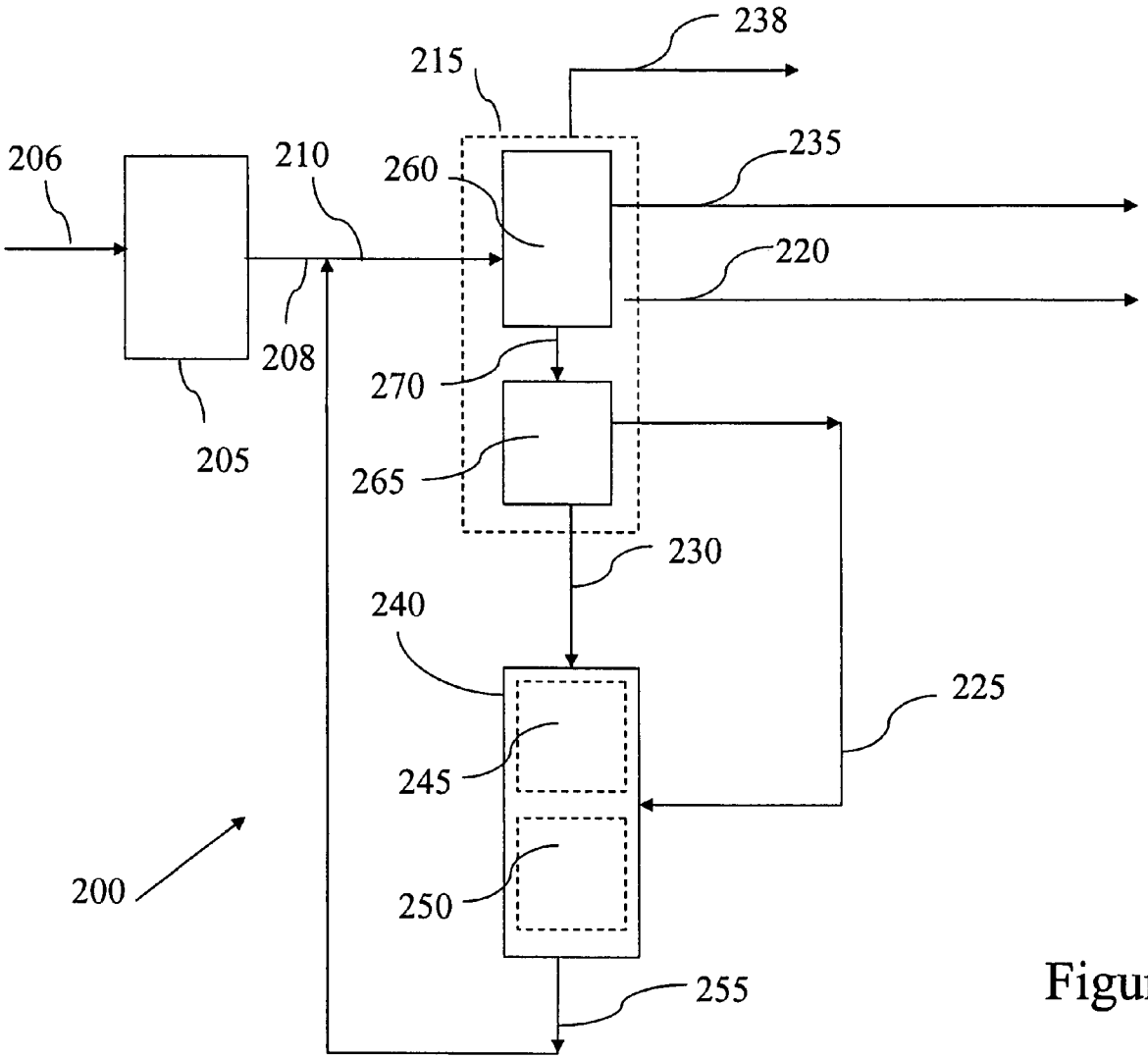
FIG. 3 shows an alternate flow diagram of FIG. 2 having two fractionator units suitable to generate two waxy fractions from a hydrocarbon feedstream and two hydrocracking zones operated in series fed by the two waxy fractions in accordance with at least one embodiment of the invention.

One alternate embodiment of the method with employs two fractionation units is illustrated in FIG. 3. The fractionation step of FIG. 3 allows the generation of a heavier fraction and a lighter fraction suitable as feedstreams to the hydrocracking unit, wherein both heavier and lighter fractions comprise hydrocarbons with a boiling point greater than about 640° F. (typically corresponding to hydrocarbons with 20 or more carbon atoms). FIG. 3 will be described later.

Referring again to FIG. 2, hydrocracking unit 140 comprises two hydroconversion zones operated in series: a first hydroconversion zone 145 and a second hydroconversion zone 150 located downstream of the first hydroconversion zone 145. Zones 145 and 150 may or may not be contained within a single bed or chamber within hydrocracking unit 140. In addition, it is within the scope of the invention that hydrocracking unit 140 may be two separate vessels or physical structures, each housing one or more hydrocracking zones (this configuration is not shown). Each hydroconversion zone 145 and 150 may experience an increase in temperature from upstream to downstream as the hydrocarbons pass each zone; however, since the catalytic hydrocracking reaction of highly paraffinic stream is not as exothermic as that of aromatic-containing stream, the temperature rise is not significant so as to require a quench to cool along each of the hydroconversion zone. The temperature at the entrance of each hydroconversion zone 140 and 145 could be adjusted by careful control of the temperature of their respective feedstream.

Feedstock to the first hydroconversion zone 145 comprises waxy fraction 130 from fractionator 115. In one preferred embodiment of FIG. 2, waxy fraction 130 preferably contains hydrotreated hydrocarbons with a boiling point equal to or greater than about 650° F.

In a standard hydrocracking configuration, hydrocracking takes place throughout a hydrocracking zone. Some of the $C_{5+}$ hydrocarbons are cracked to smaller hydrocarbons, wherein a portion of said smaller hydrocarbons are within the boiling point range of desirable products (such as naphtha, middle distillates and/or diesel). However, some of the smaller hydrocarbons formed during hydrocracking can undergo secondary cracking, as they pass through the remainder of the hydroconversion zone under conversion promoting conditions. Their long residence time in the hydroconversion zone can result in "over-cracking", and hence to the production of very light hydrocarbons with less than 5 carbon atoms, such as those comprised in exhaust 138 and/or sometimes found in naphtha fraction 135, thereby decreasing the yield of desirable middle distillate fraction 120. The idea of the present invention is to reduce secondary cracking of hydrocarbons within the boiling point range of desirable products, and to increase isomerization of hydrocarbons within the boiling point range of desirable products, and thus to increase the overall degree of branching of hydrocarbons in the desirable products, and possibly to further increase yield of the middle distillates, especially of diesel. It is believed that reducing the residence time of the lighter components (such as with a boiling point less than about 650° F.) by partial withdrawal and/or intentionally increasing the pool of lighter components by adding a light hydrocarbon stream in the hydrocracking zones will achieve the desired results. The boiling points of branched paraffins tend to be lower than that of their corresponding normal paraffin; for example, an isoparaffin with 21 carbon atoms (i-$C_{21}$) has a lower boiling point than the normal $C_{21}$ paraffin. Hence, some isomerized heavy hydrocarbons, for example the branched hydrocarbons comprising 21 to 25 carbon atoms will boil in the diesel boiling range. As a non-limiting example, if heavy wax fraction 130 comprises $C_{30+}$ hydrocarbons and is fed to the first hydroconversion zone 145, and if intermediate fraction 125 comprises a light wax with primarily $C_{20}$-$C_{30}$ hydrocarbons, and a portion 126 of intermediate fraction is fed to the second hydroconversion zone 150 placed downstream of the first zone 145, a 10-15% increase in production of hydrocarbons boiling in the diesel range can be accomplished may be expected compared to a case where both waxy fraction 130 and portion 126 of intermediate fraction are fed to the first hydroconversion zone 145.

In addition, the introduction of additional lighter hydrocarbons along the hydrocracking zone(s) favors hydroisomerization, which can increase the iso/normal paraffin ratio of the fraction 120 and/or product 129.

Substantially all of fraction 130 is fed to first hydroconversion zone 145. A purge 136 (shown in dotted line) taken from fraction 130 may be performed in order to remove some material resilient to the hydroprocessing. Purge 136 typically represents not more than about 2 percent by volume of fraction 130, preferably less than about 1 percent by volume of fraction 130.

The hydrocarbons from waxy fraction 130 pass through the first hydroconversion zone 145 under hydrocracking promoting conditions, such that some of the hydrocarbons in waxy fraction 130 are hydrocracked, i.e., the hydrocarbons are split into two smaller hydrocarbon molecules in the presence of hydrogen and a catalyst, so the carbon chain length of at least a portion of the hydrocarbons passing through zone 145 is decreased. A first hydroconverted effluent comprising hydrocracked products and unconverted hydrocarbons exit first hydroconversion zone 145 (not shown). For example, if waxy fraction 130 contains hydrocarbons with 20 or more carbon atoms, first hydroconverted effluent may comprise hydrocarbons with one carbon atom to 20 or more carbon atoms.

The method further comprises feeding to the second hydroconversion zone 150 at least a portion of the first hydroconverted effluent exiting the first hydroconversion zone 145. Preferably the hydrocarbons in the first hydroconverted effluent passing from the first (upstream) hydroconversion zone 145 to the second (downstream) hydroconversion zone 150 cascades down (without inter-zone separation) to an inter-zone distribution (not shown). Optionally, a portion 160 of first hydroconverted effluent (shown in dotted line) is not passed down to the downstream zone 150. Instead, portion 160 of first hydroconverted effluent may exit hydrocracking unit 140 and can be sent to fractionator 115 either directly (not shown) or by combining with hydrocracker effluent 155 (as illustrated). At least a portion 126 of lighter fraction 125 is also fed to second hydroconversion zone 150. A preferred embodiment comprises feeding to the second hydroconversion zone 150 substantially all of the first hydroconverted effluent exiting first hydroconversion zone 145 and at least a portion 126 of the intermediate fraction 125. Portion 126 may comprise up to 50% of fraction 125, especially when fraction 125 comprises a diesel cut, such as a heavy diesel. In other embodiments, portion 126 may comprise up to 100% of fraction 125, especially when fraction 125 comprises a wax cut, such as a light wax cut.

The method also includes introducing hydrogen gas into the hydrocracking unit 140, so that the hydrogen gas flows through the hydrocracking zones 145 and 150 and over the catalyst present in each of the two hydrocracking zones 145 and 150. The flowing hydrogen should contact the catalyst in hydrocracking zones 145 and 150, so as to favor reaction between hydrocarbons and hydrogen. The hydrogen feed may be sent only to the first hydroconversion zone 145; alternatively, some portions of the hydrogen feed may be distributed via a distribution zone upstream of each hydroconversion zone 145 and 150. For example, hydrogen could be fed in the inter-zone distribution (not shown) wherein the hydrocarbon feedstock to the second hydroconversion zone 150 is distributed.

Because the hydrocracking reaction of hydrocarbons with hydrogen is typically exothermic, the temperature of the first hydrocracked effluent first hydroconversion zone 145 may be slightly higher than the temperature desired for optimum performance of the second hydroconversion zone 150. Therefore, the portion of hydrogen feed or/and the portion 126 of intermediate fraction 125 may have a temperature sufficiently low enough while entering the second hydroconversion zone 150, so that the combined feedstream comprising hydrogen and the hydrocarbon feedstock (portion 126 and first hydrocracked effluent from first zone 145) to the second hydroconversion zone 150 has an appropriate temperature effective for the conversion of said combined feedstream in the second hydroconversion zone 150. The temperature rise in the hydrocracking zones 145 and 150 is not significant so as to require a quench to cool along each of the hydrocracking zone. The temperature of the respective feedstream (hydrogen and hydrocarbon feeds) at the entrance of each hydroconversion zone 140 and 145 is not necessarily selected so as to quench the temperature for controlling the exotherm, but more importantly, is selected in order to adjust the temperature of the hydroconversion zone within a reasonable temperature range. Therefore the method may further include admixing the first hydrocracked effluent exiting first hydroconversion zone 145 with a feedstream, as long as the feedstream has a temperature low enough so as to achieve a temperature of the admixture (comprising first hydrocracked effluent and the feedstream) within acceptable temperature conditions for downstream hydroconversion zone 150. The feedstream preferably comprises the portion 126 of the intermediate stream 125, at least a portion of the hydrogen feed, or mixture thereof.

The first hydrocracked effluent from first hydroconversion zone 145 and portion 126 of intermediate fraction 125 pass through second hydroconversion zone 150 under conditions suitable for hydrocarbon components to react with hydrogen to favor hydrocracking, hydroisomerization, dewaxing or combinations thereof, so as to form smaller and/or branched hydrocarbons. A hydrocracked effluent stream 155 exits hydrocracking unit 140. A portion 128 of intermediate fraction 125, not sent to hydrocracking unit 140, can be blended with middle distillate stream 120 to form a diesel product 129. Alternatively, the totality of intermediate fraction 125 can be sent to second hydroconversion zone 150 and middle distillate stream 120 comprises a diesel product.

Hydrocracking unit 140 may include using a bifunctional catalyst in at least one hydrocracking zone, preferably in one downstream hydroconversion zone (the second if there are only two zones). The first hydroconversion zone 145 may comprises a hydrocracking catalyst bed, and the second downstream hydroconversion zone 150 may comprise a bifunctional hydrocracking catalyst bed suitable for hydrocracking, hydroisomerization, dewaxing, or combinations thereof. This catalyst bed arrangement may further improve the degree of isomerization in the effluent 155 of hydrocracking unit 140.

Preferably, the hydrocracking in hydrocracking zones 145 and 150 takes place over at least one hydrocracking catalyst comprising a hydrogenation component and a cracking component (typically an acid component). The hydrogenation component may include a metal selected from the group consisting of platinum (Pt), palladium (Pd), nickel (Ni), cobalt (Co), tungsten (W), molybdenum (Mo), and combinations thereof. The hydrogenation component in the hydrocracking catalysts preferably includes Pt, Pd, or combination thereof. The cracking component for the hydrocracking catalyst in the first hydroconversion zone may be an amorphous cracking material and/or a molecular sieve material. A preferred cracking component comprises an amorphous silica-alumina; however Y-type zeolite, SAPO-type moleecular sieves (−11; −31; −37; −41), ZSM-type zeolites (−5; −11; −48), and dealuminated zeolites may also be used. The cracking component may support the hydrogenation component; however the catalyst may further comprise a binder, which supports both hydrogenation component and cracking component. If, for example, more hydroisomerization is desirable in the second hydroconversion zone 150, the hydrocracking catalyst in the downstream hydroconversion zone 150 could comprise a less acidic cracking component. Thus, it is envisioned that the hydrocracking catalysts in both hydroconversion zones could comprise the same hydrogenation component (such as Pt, Pd or both), but could comprise different cracking components with various acid strengths. Yet it is also noted that a catalyst gradient may comprise the two hydroconversion zones, by varying gradually the acid strength of the catalyst from high acidity at the entry point of waxy stream 130 to low acidity at the exit point of hydroconverted effluent stream 155, so as to gradually increase the hydroisomerization along hydrocracking unit 140.

Isomerization can serve to enhance certain properties of hydrocarbon mixtures. Increasing the degree of branching of hydrocarbons in a diesel fuel, which is primarily comprised on Fischer-Tropsch hydrocarbon products, can be favorable to improving its cold-flow properties, such as pour point, cloud point, cold filter plugging point and the like. The cloud point (measured by ATSM D2500) is the highest temperature used to characterize cold flow properties and the pour point (measured by ASTM D97) is the lowest. The cold filter plugging point (CFPP defined by ASTM D6371-99) temperatures will usually be in between the pour and cloud points. Thus, the pour point represents the lowest temperature (in ° F. or ° C.) at which a liquid remains pourable (meaning it still behaves as a fluid). The pour point is the lowest temperature at which a fuel can be handled without excessive amounts of wax crystals forming, and so preventing flow. If a diesel fuel is held at a temperature below its pour point, wax can begin to separate out which most likely results in blocking fuel-injection filters. In oils, the pour point is generally increased by increasing the linear paraffin content. However, isoparaffins (or branched paraffins) are known to reduce the pour point of highly paraffinic hydrocarbons mixture. Hence, adding branched hydrocarbons or converted linear hydrocarbons to branched hydrocarbons by hydroisomerization to a fuel or oil would typically improve at least one cold-flow property of this fuel or oil.

Dewaxing, which also comprises isomerization, has also been shown to be effective in decreasing the pour point of middle distillates. The catalytic dewaxing typically employs a dual-function catalytic metal/molecular sieve catalyst to hydroisomerize and selectively crack waxy hydrocarbons and generate low pour point. distillates comprising isomerized paraffins. The isomerized paraffins and selectively cracked paraffins remain in the distillate range and therefore the distillate yield in catalytic dewaxing is usually quite high (i.e., greater than 70%). Therefore, in one embodiment of the present invention, a dewaxing catalyst comprising both cracking and hydroisomerization functions may be used in one of the hydrocracking zones. Since isomerization of middle distillate range hydrocarbon distillate is particularly desirable to increase the pour point of said distillate without affecting the distillate yield, the use of catalytic dewaxing is particularly desirable in a downstream hydroconversion zone such as second hydroconversion zone 150.

Accordingly, hydrocracking unit 140 can comprise a bifunctional hydrocracking/hydroisomerizing catalyst. Any suitable bifunctional catalyst will suffice. Typically bifunctional catalysts comprise at least one metal from Groups 8, 9, 10 of the Periodic Table (new IUPAC Notation) and at least one support selected from the group consisting of alumina, titania, zirconia, magnesia, silica, thoria, silica-alumina, shape-selective material such as molecular sieves, zeolites and the like, and combinations thereof. Preferably, the bifunctional catalyst comprises nickel, cobalt, platinum, or palladium. When the bifunctional catalyst comprises cobalt or nickel, preferably it also comprises a metal from Group 6 of the Periodic Table (new IUPAC Notation), such as molybdenum or tungsten. The support should be acidic and preferably comprises a zeolitic material, an amorphous silica-alumina, or combinations thereof. When the feedstreams to hydrocracking unit 140 are primarily derived from a hydrocarbon synthesis such as a Fischer-Tropsch synthesis, a more preferred bifunctional catalyst comprises at least one metal selected from the group consisting of palladium and platinum.

The composition of the hydrocracking catalyst may be the same throughout the entire hydrocracking unit 140, including both hydroconversion zones 145 and 150. The compositions may also be the same if the hydroconversion zones 145 and 150 are housed within separate hydrocracking units. It should be understood that the active metal contents of the catalysts may differ, but the compositional makeup may remain the same from zone to zone. It should also be understood that a hydrocracking/hydroisomerization activity gradient may exist within the hydrocracking unit 140 or within either or both specific hydroconversion zones 145 and 150. The activity gradient may be achieved by varying the acidity of the catalyst along the hydrocracking unit 140 or at least one of the hydroconversion zones.

The conversion promoting conditions in both hydroconversion zones 145 and 150 are preferably at a temperature of about 500° F. to about 750° F. (260-400° C.) and at a pressure of about 500 psig to about 1500 psig (3,550-10,440 kPa), an overall hydrogen consumption of 200-10,000 standard cubic feet per barrel of hydrocarbon feed (scf $H_2$/bbl HC) or about 35-1,800 STP $m^3$ $H_2/m^3$ HC feed, preferably 200-2,000 scf $H_2$/bbl HC, preferably 200-1,000 scf $H_2$/bbl HC, using a liquid hourly space velocities based on the hydrocarbon feedstock of about 0.1 to about 10 $hr^{-1}$, preferably between 0.25 to 5 $hr^{-1}$. In some embodiments, the average temperature in hydroconversion zone 150 is lower than that of hydroconversion zone 145, in order to decrease the severity of the hydrocracking and to favor instead hydroisomerization.

In a preferred embodiment, hydrocracking in zones 145 and 150 takes place over a platinum or palladium catalyst preferably supported on a structured silica-alumina material such as a zeolite (i.e., ZSM-5) or an amorphous silica-alumina at a temperature of about 500° F. to about 750° F. (260-400° C.) and at a pressure of about 500 psig to about 1500 psig (3,550-10,440 kPa), with a hydrogen flow between 2,000 and 10,000 standard cubic feet per barrel of hydrocarbon feed.

At least a portion of hydroconverted effluent stream 155 may be fed into either fractionator feedstream 110 (as shown) or directly into fractionator 115 (configuration not shown). When substantially all of hydroconverted effluent stream 155 is sent to fractionator 115, the heavy components (those with a boiling point greater than 700° F.) are recycled close to extinction. The complete recycling of heavy components from hydroconverted effluent stream 155 to hydrocracking unit 140 thereby increases the amount of desirable hydrocarbons in the middle distillate range, thus increases the yield of desirable products represented in FIG. 2 as middle distillate stream 120 and/or diesel product 129.

An alternate embodiment of the method for producing liquid hydrocarbon products comprising more branched paraffins as illustrated in FIG. 3 employs two fractionation units. FIG. 3 represents a hydroprocessing flow diagram 200 comprising a hydrocarbon feedstream 208, an optional hydrotreator 205, a fractionator feedstream 210, a fractionator 215, fractions 220, 225, 230, 235, gas exhaust 238, hydrocracking unit 240, and hydroconverted effluent stream 255. Hydrocracking unit 240 comprises two hydroconversion zones operated in series: a first hydroconversion zone 245 and a second hydroconversion zone 250 located downstream of the first hydroconversion zone 245. Hydroconversion zones 245 and 250 may or may not be contained within a single bed or chamber within hydrocracking unit 240. In addition, it is within the scope of the invention that hydrocracking unit 240 may be two separate units or physical structures, each housing one or more hydroconversion zones (this configuration is not shown).

Hydrocarbon stream 208 may be obtained by passing a liquid hydrocarbon feedstream 206 through an optional hydrotreater 205 in the same manner as described for FIG. 2. The composition and properties of liquid hydrocarbon feedstream 206 are generally the same that described previously.

Fractionator feedstream 210 should comprise substantially all of hydrocarbon stream 108. Fractionator feedstream 210 may further comprise hydroconverted effluent stream 255 (as shown), and/or any other hydrocarbon stream (not shown) such as derived from crude oils, shale oils, and/or tar sands, which preferably has been previously hydrotreated.

In general terms, the hydrocarbons in fractionator feed 210 may be separated by fractionator 215 into a heavier fraction 230 and a lighter fraction 225. Fraction 220 may be one or more streams and is merely representative in FIG. 3 of products from fractionator 215 that are generally "lighter" than fraction 225 or are simply not used in the hydroprocessing scheme depicted and described herein. In reality, fraction 220 represents the desired diesel product from the hydroprocessing embodiment 200 of the present invention. Fraction 235 may be one or more streams and is merely representative in FIG. 3 of products from fractionator 215 that is generally "lighter" than fraction 220, or is simply not used in the hydroprocessing scheme 200 depicted and described herein. In reality, fraction 235 represents a naphtha product from the hydroprocessing embodiment 200 of the present invention. Any gas formed in hydrocracking unit 240 or passing through fractionator 215 may exit via exhaust 238. Water also exits fractionator 215 primarily in fraction 235, and sometimes in exhaust 238.

FIG. 3 differs from FIG. 2 by the use of different distillation units employed in the fractionation step. Fractionator 215 comprises an atmospheric distillation column 260 and another distillation unit 265. The other distillation unit 265 preferably comprises a short-path distillation unit and/or a vacuum distillation column. The use of vacuum or short-path distillation unit 265, in addition to the atmospheric distillation column 260 for the fractionator step, allows the generation of different wax cuts of various boiling ranges (comprising hydrocarbons with a boiling point greater than about 650° F., which typically corresponds to hydrocarbons with 20 or more carbon atoms), such that one light wax cut and one heavy wax cut can be used as separate feedstocks to the two hydrocracking zones in hydrocracking unit 240.

Fractionator feedstream 210 is fed to atmospheric distillation column 260 to generate middle distillate fraction 220, naphtha fraction 235, gas exhaust 238, and wax fraction 270, wherein wax fraction 270 has a 5% boiling point greater than that of middle distillate fraction 220 and further wherein middle distillate fraction 220 has a 5% boiling point greater than that of naphtha fraction 235.

Wax fraction 270 from atmospheric distillation column 260 is fed to distillation unit 265 so as to form a light wax fraction 225 and a heavy wax fraction 230, wherein light wax fraction 225 has a lower boiling range than heavy wax fraction 230. As a not-limiting example of such embodiment illustrated in FIG. 3, light wax fraction 225 comprises a light wax (such as comprising $C_{20}$-$C_{30}$ or $C_{20}$-$C_{25}$ hydrocarbons); fraction 220 comprises a diesel (such as comprising $C_9$-$C_{20}$ or $C_9$-$C_{22}$ hydrocarbons); heavy wax fraction 230 comprises a heavy wax stream (such as comprising $C_{30+}$ or $C_{40+}$ hydrocarbons); naphtha fraction 235 comprises a naphtha (such as comprising $C_5$-$C_{10}$ or $C_5$-$C_9$ hydrocarbons); and gas exhaust 238 comprises $C_5$-hydrocarbons.

Heavy wax fraction 230 from distillation unit 265 is fed to first hydroconversion zone 245, whereas light wax fraction 225 is fed to second hydroconversion zone 250. In one preferred embodiment of FIG. 3, heavy wax fraction 230 preferably contains hydrotreated hydrocarbons with a boiling range having a 5% boiling point equal to or greater than about 800° F. (typically representing $C_{30+}$ hydrocarbons); and light wax fraction 225 preferably contains hydrotreated hydrocarbons with a boiling range having a 5% boiling point equal to about 640° F. and a 95% boiling point equal to about 800° F. (typically representing $C_{20}$-$C_{30}$ hydrocarbons). Alternatively, light wax fraction 225 may contain hydrocarbons with a boiling range having a 5% boiling point equal to about 550° F. and a 95% boiling point equal to about 800° F. (typically representing $C_{15}$-$C_{30}$ hydrocarbons) or a boiling range having a 5% boiling point equal to about 550° F. and a 95% boiling point equal to about 640° F. (typically representing $C_{15}$-$C_{20}$ hydrocarbons).

Operating conditions and catalyst selection for hydrocracking unit 240 are preferably the same as those described for hydrocracking unit 40 of FIG. 1. Hydrocracking unit 240 further includes using a catalyst in each of the hydroconversion zones, preferably at least one bifunctional catalyst in one downstream hydroconversion zone (the second hydroconversion zone 250 when there are only two zones). The first hydroconversion zone 245 may comprise a hydrocracking catalyst bed, and the second downstream hydroconversion zone 250 may comprise a bifunctional catalyst bed under conversion promoting conditions suitable for hydrocracking, hydroisomerization, dewaxing, or combinations thereof. This catalyst bed arrangement may further improve the degree of isomerization in the hydroconverted effluent stream 255 exiting hydrocracking unit 240.

Figure 4:
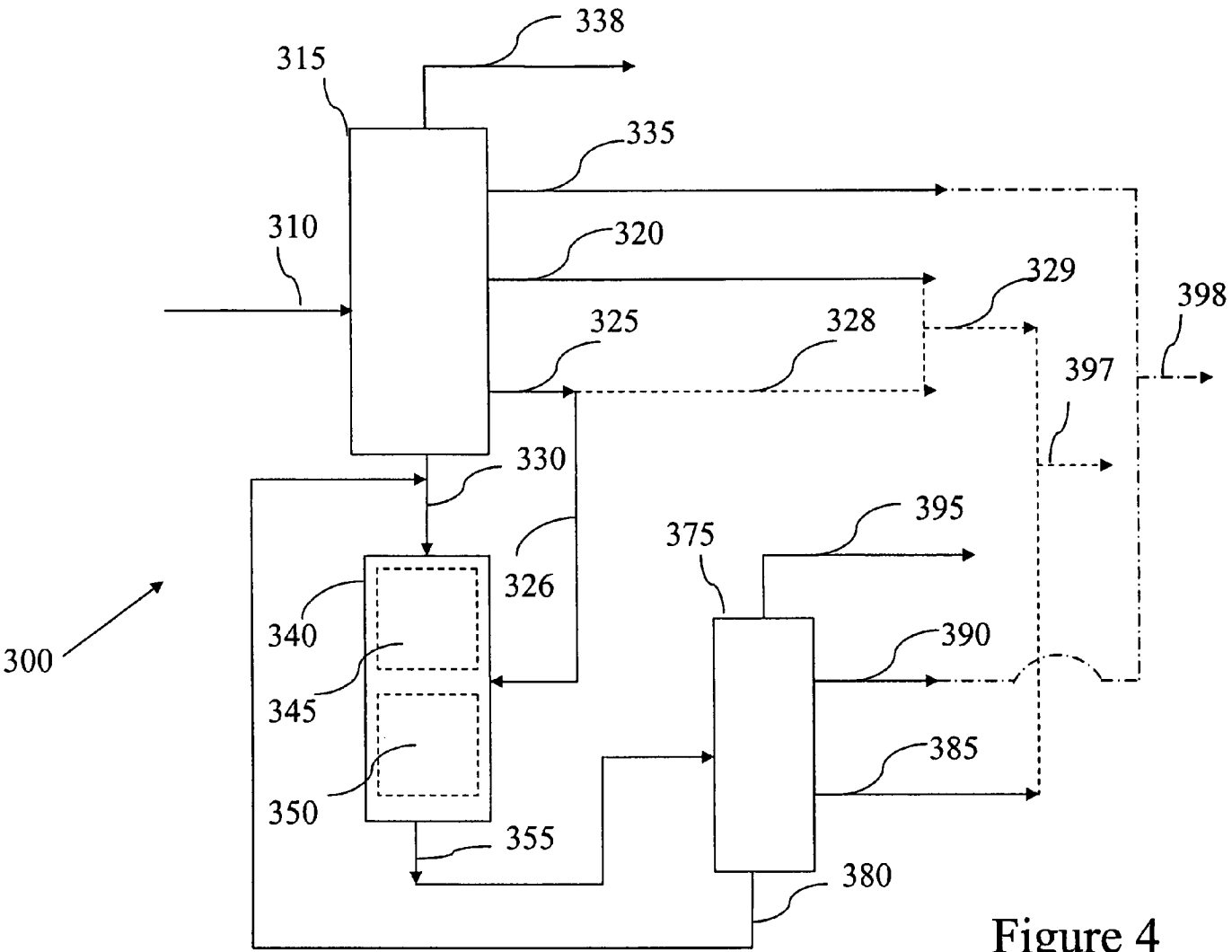
FIG. 4 shows an alternate flow diagram of FIG. 2 comprising two fractionator units one separating a hydrocarbon stream derived from a hydrocarbon synthesis, while the other separates a hydroconverted feedstream in accordance with one alternate embodiment of the invention.

FIG. 4 shows one alternate embodiment of FIG. 2 with the use of separate fractionators: one fractionator to separate hydrocarbons derived primarily from a hydrocarbon synthesis, and another fractionator to separate hydroconverted hydrocarbons. Hydroprocessing flow diagram 300 comprises a fractionator feedstream 310 (obtained similarly as streams 110 and 210 as described in FIGS. 2 and 3), a first fractionator 315, a second fractionator 375, fractions 320, 325, 330, 335, and exhaust 338 from first fractionator 315, hydrocracking unit 340, and hydroconverted effluent stream 355 exiting hydrocracking unit 340. The hydroprocessing scheme 300 proceeds similarly to FIG. 2, except that effluent 355 of hydrocracking unit 340 is fed to the second fractionator 375 to generate fractions 380, 385, 390, and exhaust 395 from second fractionator 375. Hydrocracking unit 340 comprises two hydroconversion zones operated in series: a first hydroconversion zone 345 and a second hydroconversion zone 350 located downstream of the first hydroconversion zone 345. Hydroconversion zones 345 and 350 may or may not be contained within a single bed or chamber within hydrocracking unit 340. In addition, it is within the scope of the invention that hydrocracking unit 340 may be two separate units or physical structures, each housing one or more zones (this configuration is not shown).

In general terms, fractionator feedstream 310 preferably comprise a $C_{5+}$ hydrocarbon product from a hydrocarbon synthesis reactor (not shown), which optionally has been hydrotreated, as is described in FIG. 2. Fractionator feedstream 310 may further comprise some other hydrocarbon source(s) such as derived from crude oils, shale oils and/or tar sands. Fractionator feedstream 310 is introduced into fractionator 315 to be separated into at least a heavier fraction 330 and a lighter fraction 325. Each of fractions 320 and 335 may be one or more streams and are merely representative in FIG. 4 of products from fractionator 315 that are generally "lighter" than fraction 325 or are simply not used in the hydroprocessing scheme depicted and described herein. In reality, fraction 320 represents at least a portion of desired diesel products and fraction 335 represents at least a portion of a naphtha stream from the hydroprocessing embodiment 300 of the present invention. Any gaseous hydrocarbons created in hydrocracking unit 340 and/or passing through fractionator 315 may exit via exhaust 338. Water can also exit fractionator 315 primarily via lighter fraction 325, and sometimes may be present in exhaust 338.

The type of fractionator for units 315 and 375 is not critical to the present invention and can comprise any of the fractionator technology and/or methods known in the art. One of ordinary skill in the art will readily understand the types of fractionators useful for separating liquid hydrocarbons of this nature into the various fractions described herein. For ease of discussion, and without any intention to be so limited, fractionators 315 and 375 can comprise a standard atmospheric fractional distillation apparatus.

Accordingly, fractionator feedstream 310 is fed to fractionator 315 in order for its components to be separated based on their boiling point, so as to generate various hydrocarbon fractions 320, 325, 330, 335, and exhaust 338 of different boiling ranges. As an example, feedstream 310 may be separated into a gas exhaust 338 (comprising $C_1$-$C_5$ hydrocarbons), a naphtha fraction 335 (comprising about $C_5$-$C_9$ hydrocarbons), a light diesel fraction 320 (comprising at least about $C_9$-$C_{15}$ hydrocarbons), an intermediate stream 325 (comprising about $C_{15}$-$C_{22}$ or about $C_{15}$-$C_{30}$ hydrocarbons), and a wax fraction 330 (comprising about $C_{20+}$ hydrocarbons).

Fraction 320 could comprise at least a portion of 'straight-run' diesel obtained from a Fischer-Tropsch synthesis, so called 'straight-run' because the carbon backbone of its components is quite similar to the original components from the hydrocarbon synthesis in the diesel boiling range. Fraction 325 may also comprise a fraction of 'straight-run' diesel. In one embodiment of FIG. 4, fraction 320 and 325 comprises a light fraction and a heavy fraction of 'straight run' diesel, respectively. Preferably, the 'straight-run' diesel is obtained by the use of a low-temperature Fischer-Tropsch synthesis, such as employing a temperature between about 370° F. and about 500° F. (190° C.-260° C.), preferably between about 400° F. and about 445° F. (about 205° C.-230° C.). Such 'straight-run' diesel from a low-temperature Fischer-Tropsch synthesis comprises mostly linear hydrocarbons, i.e., greater than 75% linear paraffins. If fractionator feedstream 310 is hydrotreated prior to being fed to fractionator 315, then the hydrotreated 'straight-run' diesel from a low-temperature Fischer-Tropsch synthesis comprise mostly linar paraffins; i.e., has at least 90% linear paraffins.

Wax fraction 330 is fed to first hydroconversion zone 345, where some of the hydrocarbons are cracked to smaller hydrocarbons to generate a first hydroconverted effluent exiting first hydroconversion zone 345 (not shown). First hydroconverted effluent and at least a portion 326 of intermediate stream 325 are then passed through second hydroconversion zone 350 to generate a second hydroconverted effluent stream 355 exiting hydrocracking unit 340.

Hydroconverted effluent stream 355 is sent to second fractionator 375 in order for its components to be separated based on their boiling point, so as to generate various hydrocarbon fractions 380, 385, 390, and exhaust 395 of different boiling ranges. As an example, hydroconverted effluent stream 355 is separated into a second gas exhaust 395 (comprising about $C_1$-$C_5$ hydrocarbons), a second naphtha fraction 390 (comprising about $C_5$-$C_9$ hydrocarbons), a second diesel fraction 385 (comprising about $C_9$-$C_{22}$ hydrocarbons), and a second wax fraction 380 (comprising $C_{20+}$ hydrocarbons). Second wax fraction 380 is preferably sent to hydrocracking unit 340, particularly to first hydroconversion zone 345, for further hydroconversion in hydrocracking unit 340.

Streams 390 and 335 may be combined to form a naphtha range product 398. Streams 385, 320 and optionally a portion 328 of fraction 325 may be combined to form a diesel product 397 with acceptable cold-flow property (such as pour point and/or cold filter plugging point).

The hydrocracking conditions in both hydroconversion zones 345 and 350 are similar to those generally described in FIG. 2 for zones 145 and 150.

A particularly preferred embodiment of this hydroprocessing scheme 300 is the use of a bifunctional catalyst in the second hydroconversion zone 350, so as to favor hydroisomerization of hydrocarbons in hydroconversion zone 350. The enhanced isomerization, which takes place in downstream hydroconversion zone 350, should result in obtaining an effluent 355 of hydrocracking unit 340 with a large proportion of branched hydrocarbons, particularly in the diesel and naphtha boiling ranges. Preferably the second (downstream) hydroconversion zone 350 in hydrocracking unit 340 comprises some hydroisomerization promoting conditions, such that the ratio of branched/linear paraffins is greatly enhanced in hydroconverted effluent stream 355. To favor hydroisomerization in downstream hydroconversion zone 350, hydroconversion zone 350 may comprise a dewaxing catalyst with some hydrocracking function and a dominant hydroisomerization function. The dewaxing catalyst in downstream hydroconversion zone 350 preferably includes a shape-selective zeolite, such as any of ZSM-5, ZSM-11, ZSM-12, ZSM-22, ZSM-23, ZSM-35, and ZSM-38 zeolites. The dewaxing catalyst may comprise a hydrogenation component such as a metal from Groups 8-12 of the Periodic Table (new IUPAC Notation), such as palladium, platinum, rhenium, rhodium, nickel, cobalt, molybdenum, tungsten, copper, or combinations thereof. Combinations of one or more noble metals together with non-noble metals are of interest. Base metal hydrogenation components may also be used in a dewaxing catalyst, especially nickel, cobalt, molybdenum, tungsten, copper or sometimes zinc. Suitable combinations of metals in a dewaxing catalyst would include platinum-tungsten, platinum-nickel, platinum-nickel-tungsten, cobalt-nickel, cobalt-molybdenum, nickel-tungsten, cobalt-nickel-tungsten, or cobalt-nickel-titanium.

The use of a bifunctional catalyst in the second hydroconversion zone 350 results in obtaining hydroconverted effluent stream 355 with a significant content in branched hydrocarbons. Highly-branched hydroconverted effluent stream 355 can be separated in fractionator 375 to generate wax fraction 380, diesel fraction 385, and naphtha fraction 390, all with a high degree of branching.

In one embodiment of FIG. 4, a "straight-run" diesel 329 is produced. "Straight-run" diesel 329 preferably comprises fraction 320 and optionally a portion 328 of fraction 325. If fractions 320 and 325 both comprise hydrotreated diesel-range hydrocarbons derived from a low-temperature Fischer-Tropsch synthesis, such as employing a temperature between about 370° F. and about 500° F. (190° C.-260° C.), the resulting "straight-run" diesel 329 comprises mainly linear paraffins As an example, 'straight-run' diesel 329 comprises mostly normal paraffins comprising about from 9 to about 22 carbon atoms (typically more than 85 wt % $C_9$-$C_{22}$ n-paraffins); has a high cetane number (i.e., typically greater than 70, preferably greater than 75), may have some oxygenates derived from Fischer-Tropsch synthesis [especially when an "ultra-low severity" hydrotreating step is employed] or substantially no oxygenates derived from Fischer-Tropsch synthesis [especially when a mild hydrotreating step is employed]; has a very low degree of isomerization, ie., contains only a small amount of isomers of paraffins (called isoparaffins), i.e., contains less than 5 wt % of isoparaffins; and has a very low degree of aromatization, i.e., contains less than 5 wt % of aromatics. "Straight-run" diesel 329 can be combined in part with fraction 385 so as to form diesel product 397. Fraction 385 should comprise a greater percentage of branched hydrocarbons than "straight-run" diesel 329, due to the operating conditions used in hydrocracking unit 340. The relative proportion of "straight-run" diesel 329 and fraction 385 to make diesel 397 can be selected, so that diesel 397 has a desired ratio of branched to normal hydrocarbons in order to achieve at least one desirable cold-flow property in diesel 397. Similarly, fraction 335 comprising mainly linear hydrocarbons, can be combined in part with fraction 390 comprising branched hydrocarbons to form a naphtha product 398. Naphtha product 398 should have a more desirable ratio of branched to normal hydrocarbons so as to improve slightly its octane number.

Figure 5:
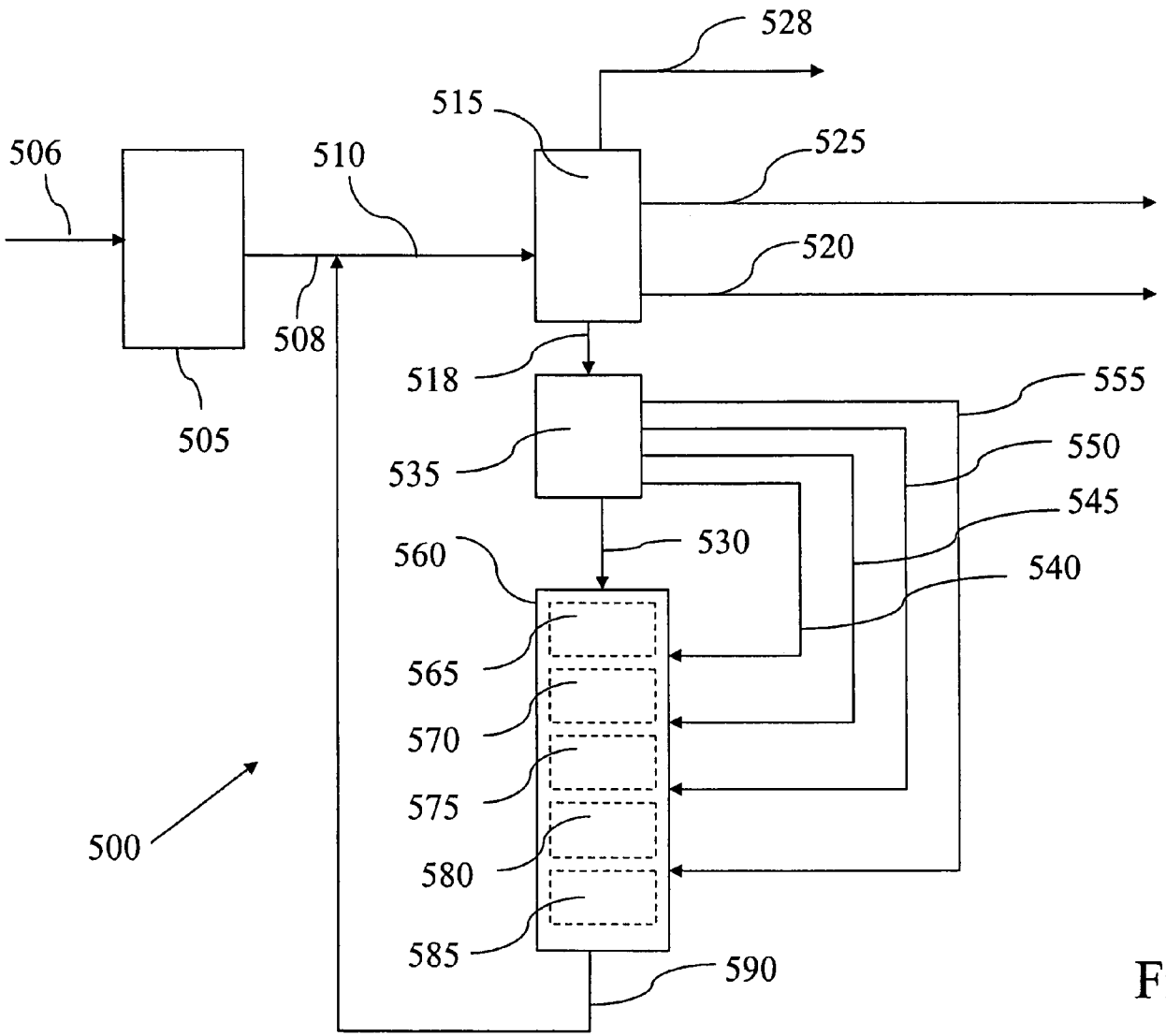
FIG. 5 shows an alternate flow diagram of FIG. 3 having multiple hydrocracking zones in series and multiple hydrocarbon feed streams in accordance with at least one embodiment of the invention.

Another embodiment of the present invention employs a hydrocracking unit having a plurality of hydroconversion zones operated in series and multiple hydrocarbon streams with different boiling ranges, which are fed into the multiple hydroconversion zones successively. FIG. 5 shows one embodiment having this general design. The hydroprocessing apparatus 500 in FIG. 5 comprises a hydrotreator 505 (optional), a fractionator feedstream 510, a first fractionator 515, a second fractionator 535, fractions 518, 520, 525, and exhaust 528 from first fractionator 515, fractions 530, 540, 545, 550, 555 from second fractionator 535, and a hydrocracking unit 560 having multiple hydroconversion zones 565, 570, 575, 580, and 585, and a hydroconverted effluent stream 590.

Optionally-hydrotreated hydrocarbon stream 508 may be obtained by passing hydrocarbon product stream 506 through hydrotreater 505 in the same manner as described for FIG. 2. Like the embodiments shown in FIGS. 2 and 3, the composition and properties of hydrocarbon product stream 506 are generally the same that described previously for 106.

Fractionator feedstream 510 should comprise optionally-hydrotreated hydrocarbon stream 508. Fractionator feedstream 510 may further comprise hydroconverted effluent stream 590 (as shown), and/or other hydrocarbon stream(s) (not shown) such as derived from crude oils, shale oils, and/or tar sands, which preferably has been previously hydrotreated.

Like in FIG. 3, the fractionation step uses different types of distillation units. The use of different types of distillation methods allows the generation of a plurality of wax cuts of various high boiling ranges (comprising hydrocarbons with a 5% boiling point greater than about 640° F., which typically corresponds to hydrocarbons with 20 or more carbon atoms), such that the plurality of wax cuts can serve as separate feedstocks to a multitude of hydrocracking zones in hydrocracking unit 560.

Accordingly, fractionator 515 separates fractionator feedstream 510 into various fraction 518, 520, 525, and gas exhaust 528. Fractions 520 and 525 may be representative in FIG. 5 of products from fractionator 515 that are generally "lighter" than fraction 518 or are simply not used in the hydroprocessing scheme 500 depicted and described herein. However, fraction 520 typically represents one of the desired products (middle distillate), whereas fraction 525 typically represents a naphtha stream from the hydroprocessing embodiment 500 of the present invention. Any gas formed in hydrocracking unit 560 or passing through fractionator 515 may exit via exhaust 528. Water can also exit fractionator 515 primarily via fraction 525, and sometimes may be present in exhaust 528. It should be noted that fractionator 515 may comprise one distillation unit or a multitude of distillation units, preferably fractionator 515 comprises an atmospheric distillation in order to achieve the desired number of fractions. For example one distillation column run at atmospheric pressure could yield a $C_{20+}$ fraction (wax 518), a $C_9$-$C_{22}$ fraction (diesel 520), a $C_5$-$C_8$ fraction (naphtha 525), and a $C_1$-$C_4$ fraction (exhaust 528). One might need to feed the wax $C_{20+}$ fraction to another distillation column run under vacuum in order to recover a $C_{30+}$ fraction and a $C_{20}$-$C_{30}$ fraction.

Heavy stream 518 from the first fractionator 515 is fed to fractionator 535 to be separated into various fractions 530, 540, 545, 550, and 555 of different boiling ranges with decreasing 95% boiling points. It should be noted that fractionator 535 may comprise one distillation unit or a multitude of distillation units, preferably fractionator 535 comprises a vacuum distillation in order to achieve the desired number of fractions.

In general, fractions 530, 540, 545, 550, and 555 are fed into hydrocracking unit 560 successively in terms of highest boiling point ranges to lowest. For example, fraction 530 may introduce a $C_{60+}$ stream, fraction 540 a $C_{50}$-$C_{60}$ stream, fraction 545 a $C_{40}$-$C_{50}$ stream, fraction 550 a $C_{30}$-$C_{40}$ stream and fraction 555 a $C_{20}$-$C_{30}$ stream. Fractions 530, 540, 545, 550, and 555 may be fed to separate hydroconversion zones 565, 570, 575, 580 and 585, respectively. At least a portion of the hydrocarbons passing through each hydroconversion zone may be successively passed to the next subsequent zone, i.e., a portion of the hydrocarbons preferably pass from hydroconversion zone 565 into hydroconversion zone 570 along with fraction 540. The hydroconversion zones 565, 570, 575, 580 and 585 may or may not be contained within a single hydrocracking vessel, provided that the flow is consistent with the scope of the present invention. In other words, hydrocracking unit 560 may comprise multiple units (not shown) each containing one or more of the hydroconversion zones. Hydrogen feed is supplied to hydrocracking unit 560 in a similar fashion as described in FIG. 2.

At least a portion of the hydrocracking unit effluent stream 590 flowing out of the hydroconversion zone 560 may be fed directly (configuration not shown) to fractionator 515 or via fractionator feedstream 510 (as shown).

In addition, any portion of hydrocarbons removed from hydrocracking unit 560, ie., any portion of hydroconverted effluent from a hydroconversion zone which is not passed to a subsequent hydroconversion zone, may also be fed directly to fractionator 515 or via fractionator feedstream 510, or directed to other uses as desired (configuration not shown).

These general ideas are also incorporated into embodiments comprising larger processes and systems for converting hydrocarbon gases to liquids. For example, one embodiment generally comprises a method for converting synthesis gas (typically produced from a syngas type reactor) into liquid hydrocarbons via a Fischer-Tropsch type synthesis. The liquid hydrocarbons may then be hydroprocessed using the various embodiments disclosed herein into final products, e.g., diesel and naphtha.

Figure 6:
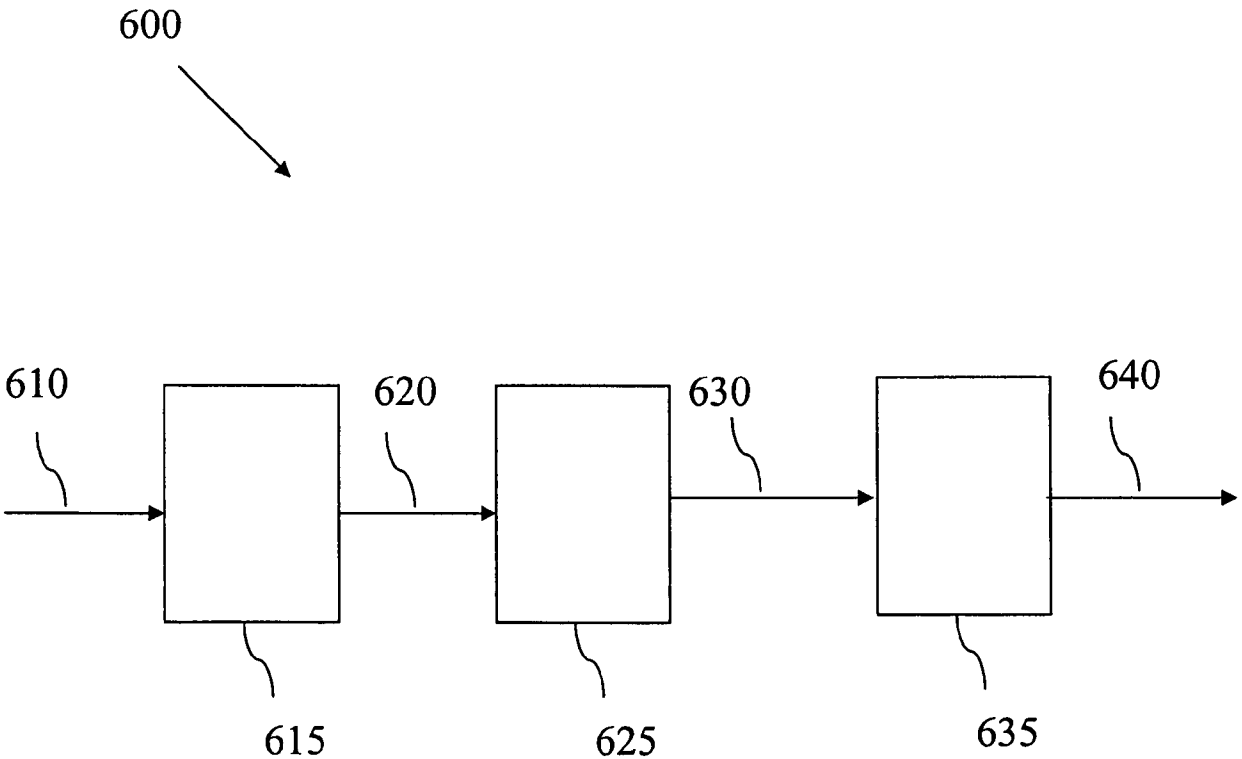
FIG. 6 shows a flow diagram of a gas to liquids process in accordance with at least one embodiment of the present invention.

FIG. 6 shows one embodiment of a hydrocarbon gas to liquids process in accordance with the spirit of the present invention. The gas to liquids process 600 comprises the steps of synthesis gas generation 615, hydrocarbon synthesis 625, and hydroprocessing 635. Synthesis gas feedstock 610, e.g., light hydrocarbons such as natural gas or methane and an oxidant such as molecular oxygen, water, or combination thereof, are fed into a synthesis gas reactor 615 to produce a gas stream 620 comprising primarily a mixture of hydrogen ($H_2$) and carbon monoxide (CO), called synthesis gas or syngas. Gas stream 620 can be obtained from synthesis gas feedstock 610 comprising at least one light hydrocarbon, such as methane, or mixtures of $C_1$-$C_4$ hydrocarbons such as natural gas, by means of steam reforming, auto-thermal reforming, dry reforming, advanced gas heated reforming, partial oxidation, catalytic partial oxidation, combinations thereof, or other processes known in the art. Alternatively, gas stream 620 comprising synthesis gas may be obtained from a variety of other synthesis gas feedstock 610 such as higher chain hydrocarbon liquids or solids such as coal and coke, or biomass, etc., all of which are clearly known in the art. In this alternate embodiment, synthesis gas generation 615 may comprise a gasification.

Gas stream 620 comprising a $H_2$/CO mixture is fed into a hydrocarbon synthesis reactor 625 (typically comprising a Fischer-Tropsch synthesis) to produce a wide range of hydrocarbons 630 (from gas to wax; i.e., from $C_1$ to $C_{100}$ or more hydrocarbons). The hydrocarbons 630 may then be hydroprocessed in hydroprocessing 635 to produce the desired liquid hydrocarbon products 640. The hydroprocessing 635 configuration may be any of the general ideas and embodiments disclosed herein.

It will be readily understood by one of ordinary skill in the art that various other processes or steps are necessary for carrying out a gas to liquids process. For example, the temperature or the water content of the gas stream 620 leaving the synthesis gas generation unit 615 will be too high to directly enter the hydrocarbon synthesis reactor 625, thereby requiring cooling of gas stream 620 and/or removing the water from gas stream 620. Another example is that the pressure of gas stream 620 leaving the synthesis gas generation 615 may be too low to directly be fed to hydrocarbon synthesis reactor 625, thereby requiring compression of gas stream 620. These additional intermediate processes or units, such as compressors, heat exchangers and water separation vessels are assumed.

Syngas and Fischer-Tropsch reactors and reactions, including catalysts and process designs, are expressly mentioned herein only as a preferred embodiments and for the sake of clarity and illustration. One skilled in the art will readily understand the applicability of the present invention towards other synthesis catalysts and reaction systems. Thus, this specificity should not be interpreted as limiting but instead the present invention should be limited only by the claims as provided.

Nonetheless, a syngas reactor in synthesis gas generation 615 can comprise any of the synthesis gas technology and/or methods known in the art. In preferred embodiments, the conversion step in synthesis gas generation 615 comprises a reaction between a light hydrocarbon gas and an oxidant. The hydrocarbon-containing feedstock 610 is almost exclusively obtained as one or more light hydrocarbons, such as natural gas or methane. However, the most important component of gas stream 610 is generally methane. Other suitable hydrocarbon feedstocks (hydrocarbons with four carbons or less) are also readily available. Similarly, the oxidant may come from a variety of sources and will be somewhat dependent upon the nature of the reaction being used. For example, a partial oxidation reaction requires diatomic oxygen as the oxidant feedstock while steam reforming requires only steam as the oxidant, and dry reforming employs $CO_2$ as the oxidant. An autothermal reforming reaction combining partial oxidation reaction and steam reforming uses both diatomic oxygen and water as oxidant feedstocks. According to the preferred embodiment of the present invention, partial oxidation, and particularly catalytic partial oxidation, is assumed for at least part of the syngas production reaction which takes place in synthesis gas generation 615.

Regardless of the feedstocks sources, the hydrocarbon-containing feed and the oxidant-containing feed are reacted under catalytic conditions in synthesis gas generation 615. The catalyst compositions useful for synthesis gas reactions are well known in the art. They generally are comprised of a catalytic metal. The most common catalytic metals are metals from Groups 8, 9, and 10 of the Periodic Table (new IUPAC notation) such as noble metals. The support structures may be monoliths, wire mesh and/or particulates. Often, the support selected will dictate the type of catalyst bed that must be used. For example, fixed beds are comprised of monoliths and large particle sized supports (such as larger than 0.5 mm). Supports comprised of small particles tend to be more useful in fluidized beds (gas and solid phases) and/or slurry beds (with gas, liquid and solid phases). The support matrix usually comprises an inorganic oxide, such as alumina, titania, silica, zirconia, or combinations thereof such as silica-alumina. The support matrix may be modified or stabilized by at least one modifier, stabilizer, or structural promoter, in order to confer resistance to support sintering and/or metal sintering in high temperature environments.

The synthesis gas feedstock 610 is generally preheated and passed over or through the catalyst bed in synthesis gas generation 615. As the feedstock 610 contacts the catalyst, synthesis reactions take place. Gas stream 620 comprising synthesis gas product contains primarily hydrogen and carbon monoxide, however, many other minor components may be present in gas stream 620, including steam, nitrogen, carbon dioxide, ammonia, hydrogen cyanide, etc., as well as unreacted feedstock, such as methane, other light hydrocarbons, water, and/or oxygen. Gas stream 620 comprising synthesis gas, i.e., syngas, is then ready to be used, treated, or directed to its intended purpose. For example, in the instant case some or all of the gas stream 620 comprising syngas will be used as a feedstock for the hydrocarbon synthesis process 625.

The hydrocarbon synthesis reactor in hydrocarbon synthesis process 625 preferably comprises a Fischer-Tropsch reactor. Any Fischer-Tropsch technology and/or methods known in the art will suffice, however, a slurry bubble reactor is preferred. The feed gas charged to the process of the invention comprises synthesis gas. In addition, feed gas may further comprise off-gas recycle from the present or another Fische-Tropsch process. Preferably the hydrogen is provided by free hydrogen, although some Fischer-Tropsch catalysts have sufficient water gas shift activity to convert some water (and CO) to hydrogen (and $CO_2$) for use in the Fischer-Tropsch process. It is preferred that the molar ratio of hydrogen to carbon monoxide in the feed gas 620 be greater than 0.5:1 (e.g., from about 0.67 to about 2.5). Preferably, when cobalt, nickel, and/or ruthenium catalysts are used, the feed gas 620 contains hydrogen and carbon monoxide in a molar ratio of about 1.4:1 to about 2.3:1. Preferably, when iron catalysts are used, the feed gas stream contains hydrogen and carbon monoxide in a molar ratio between about 1.4:1 and about 2.2:1. The feed gas 620 may also contain carbon dioxide. The feed gas 620 should contain only a low concentration of compounds or elements that have a deleterious effect on the catalyst, such as poisons. For example, the feed gas 620 may need to be pretreated to ensure that it contains low concentrations of sulfur or nitrogen compounds such as hydrogen sulfide, hydrogen cyanide, ammonia and carbonyl sulfides.

The feed gas 620 to the hydrocarbon synthesis reactor is contacted with the catalyst in a reaction zone inside unit 625. Mechanical arrangements of conventional design may be employed as the reaction zone including, for example, fixed bed, fluidized bed, slurry bubble column or ebullating bed reactors, among others. Accordingly, the preferred size and physical form of the catalyst particles may vary depending on the reactor in which they are to be used. A reaction zone employing a slurry bubble column is preferred, and accordingly the catalyst particles have a preferred weight average size between about 30 microns and about 150 microns.

The Fischer-Tropsch process 625 is typically run in a continuous mode. In this mode, the gas hourly space velocity through the reaction zone typically may range from about 50 $hr^{-1}$ to about 10,000 $hr^{-1}$, preferably from about 300 $hr^{-1}$ to about 2,000 $hr^{-1}$. The gas hourly space velocity defined as the volume of gas feed per time per reaction zone volume. The volume of gas feed is at standard conditions of pressure (101 kPa) and temperature (0° C.). The reaction zone volume is defined by the portion of the reaction vessel volume where the reaction takes place and which is occupied by a gaseous phase comprising reactants, products and/or inerts; a liquid phase comprising liquid/wax products and/or other liquids; and a solid phase comprising catalyst. The reaction zone temperature is typically in the range from about 160° C. to about 300° C. Preferably, the reaction zone is operated at conversion promoting conditions at temperatures from about 190° C. to about 260° C.; more preferably from about 205° C. to about 230° C. The reaction zone pressure is typically in the range of about 80 psia (552 kPa) to about 1000 psia (6895 kPa), more preferably from 80 psia (552 kPa) to about 800 psia (5515 kPa), and still more preferably, from about 140 psia (965 kPa) to about 750 psia (5170 kPa). Most preferably, the reaction zone pressure is from about 250 psia (1720 kPa) to about 650 psia (4480 kPa).

When the Fischer-Tropsch reactor comprises a slurry bubble column reactor, the syngas feedstock bubbles up through the slurry. The gas fed to the column generally serves to maintain some level of mixing as the gas moves up the column. As the gas moves upward, it comes in contact with the catalyst material and the hydrocarbon synthesis reaction takes place. Products are formed including hydrocarbons and water. Water is a by-product of the Fischer-Tropsch reaction as shown in Equation (1).

$$CO+2H_2 \leftrightarrows (CH_2)+H_2O \quad (1)$$

Fischer-Tropsch catalysts are well known in the art and generally comprise a catalytically active metal, a promoter and optionally a support structure. The most common catalytic metals are Group 8, 9 and 10 metals of the Periodic Table (new IUPAC Notation), such as cobalt, nickel, ruthenium, and iron or mixtures thereof. The preferred metals used in Fischer-Tropsch catalysts with respect to the present invention are cobalt, iron and/or ruthenium, however, this invention is not limited to these metals or the Fischer-Tropsch reaction. Other suitable catalytic metals include Groups 8, 9 and 10 metals. The promoters and support material are not critical to the present invention and may be comprised, if at all, by any composition known and used in the art. Promoters suitable for Fischer-Tropsch synthesis may comprise at least one metal from Group 1, 7, 8, 9, 10, 11, and 13. When the catalytic metal is cobalt, the promoter is preferably selected from the group consisting of ruthenium (Ru), platinum (Pt), palladium (Pd), rhenium (Re), boron (B), silver (Ag), and combinations thereof. When the catalytic metal is iron, the promoter is preferably selected from the group consisting of lithium (Li), copper (Cu), potassium (K), silver (Ag), manganese (Mn), sodium (Na), and combinations thereof. The preferred support composition when used preferably comprises an inorganic oxide selected from the group consisting of alumina, silica, titania, zirconia and mixtures thereof. The inorganic oxide is preferably stabilized by the use of a structural promoter or stabilizer, so as to confer hydrothermal resistance to the support and the catalyst made therefrom. In preferred embodiments, Fischer-Tropsch process 625 comprises one or more hydrocarbon synthesis reactors and each reactor comprises a slurry bubble column operated with particles of a cobalt catalyst. The cobalt catalyst particles preferably comprise a weight average particle size between about 30 microns and 150 microns.

While preferred embodiments of this invention have been shown and described, modifications thereof can be made by one skilled in the art without departing from the spirit or teaching of this invention. The embodiments described herein are exemplary only and are not limiting. Many variations and modifications of the processes are possible and are within the scope of this invention. Accordingly, the scope of protection is not limited to the embodiments described herein, but is only limited by the claims that follow, the scope of which shall include all equivalents of the subject matter of the claims. In addition, unless order is explicitly recited, the recitation of steps in a claim is not intended to require that the steps be performed in any particular order, or that any step must be completed before the beginning of another step.

What is claimed is:

1. A method for increasing the degree of isomerization of a diesel product comprising:

(a) reacting a mixture of hydrogen and carbon monoxide at conversion promoting conditions to form a synthetic hydrocarbon stream, wherein the synthetic hydrocarbon stream comprises primarily $C_{5+}$ paraffins;

(b) hydrotreating the synthetic hydrocarbon stream under mild hydrotreating conditions;

(c) forming a fractionator feedstream comprising the hydrotreated synthetic hydrocarbon stream;

(d) separating the fractionator feedstream into at least three fractions including:

(i) a light fraction;

(ii) an intermediate fraction; and (iii) a heavy fraction;

wherein the light fraction has a boiling range with a 5% boiling point of about 300° F., wherein the intermediate fraction has a boiling range with a 5% boiling point lower than that of the heavy fraction, and higher than that of the light fraction;

(e) passing at least a portion of the heavy fraction to a first hydroconversion zone containing a hydrocracking catalyst;

(fe) reacting at least a portion of the heavy fraction from step (d) with hydrogen under hydrocracking promoting conditions in the first hydroconversion zone to form a first hydroconverted effluent;

(g) passing at least a portion of the first hydroconverted effluent to a second hydroconversion zone;

(h) passing at least a portion of the intermediate fraction to the second hydroconversion zone; and (i) reacting at least a portion of the first hydroconverted effluent and at least a portion of the intermediate fraction with hydrogen in the second hydroconversion zone with a catalyst under conditions suitable to promote hydroisomerization, hydrocracking, dewaxing, or combinations thereof, to form a second hydroconverted effluent, wherein the portion of the intermediate fraction passed to the second hydroconversion zone and the portion of the first hydroconverted effluent passed to the second hydroconversion zone have lost their separate identities.

2. The method of claim 1 further comprising (i) separating the second hydroconverted effluent produced in step (h) to create at least a middle distillate fraction therefrom.

3. The method of claim 2 further comprising forming a synthetic paraffinic fuel by blending (1) at least a portion of the light fraction from step (b);
(2) at least a portion of the middle distillate fraction from step (i); and
(3) optionally, a portion of the intermediate fraction from step (b) not passed to second hydroconversion zone.

4. The method of claim 2 wherein the fractionation of steps (c) and (i) are carried out in the same fractionator.

5. The method of claim 2 wherein the fractionation of steps (c) and (i) are carried out in different fractionators.

6. The method of claim 1 wherein the hydrocarbon synthesis in step (a) comprises a Fischer-Tropsch synthesis.

7. The method of claim 1 wherein the fractionator feedstream of step (b) further comprises hydrocarbons derived from refining of a crude oil, shale oil, or tar sand source.

8. A method for increasing the degree of isomerization of a diesel product comprising:

(a) reacting a mixture of hydrogen and carbon monoxide at conversion promoting conditions to form a synthetic hydrocarbon stream, wherein the synthetic hydrocarbon stream comprises primarily $C_{5+}$ paraffins;
(b) forming a fractionator feedstream comprising the synthetic hydrocarbon stream;
(c) separating the fractionator feedstream into at least three fractions including:
(i) a light fraction;
(ii) an intermediate fraction; and
(iii) a heavy fraction;
wherein the light fraction has a boiling range with a 5% boiling point of about 300° F., wherein the intermediate fraction has a boiling range with a 5% boiling point lower than that of the heavy fraction, and higher than that of the light fraction;
(d) passing at least a portion of the heavy fraction to a first hydroconversion zone containing a hydrocracking catalyst;
(e) reacting at least a portion of the heavy fraction from step (d) with hydrogen under hydrocracking promoting conditions in the first hydroconversion zone to form a first hydroconverted effluent;
(f) passing at least a portion of the first hydroconverted effluent to a second hydroconversion zone;
(g) passing at least a portion of the intermediate fraction to the second hydroconversion zone; and
(h) reacting at least a portion of the first hydroconverted effluent and at least a portion of the intermediate fraction with hydrogen in the second hydroconversion zone with a catalyst under conditions suitable to promote hydroisomerization, hydrocracking, dewaxing, or combinations thereof, to form a second hydroconverted effluent, wherein the portion of the intermediate fraction passed to the second hydroconversion zone and the portion of the first hydroconverted effluent passed to the second hydroconversion zone have lost their separate identities.

wherein the synthetic hydrocarbon stream is hydrotreated under "ultra-low severity" hydrotreating conditions before forming step (b).

9. The method of claim 1 wherein the second hydroconversion zone is located downstream of the first hydrocracking zone.

10. The method of claim 9 wherein the second hydroconversion zone comprises a dewaxing catalyst.

11. The method of claim 1 wherein the second hydroconversion zone comprises hydroisomerization promoting conditions.

12. A method for increasing the degree of isomerization of a diesel product comprising:

(a) reacting a mixture of hydrogen and carbon monoxide at conversion promoting conditions to form a synthetic hydrocarbon stream, wherein the synthetic hydrocarbon stream comprises primarily $C_{5+}$ paraffins;
(b) forming a fractionator feedstream comprising the synthetic hydrocarbon stream;
(c) separating the fractionator feedstream into at least three fractions including;
(i) a light fraction:
(ii) an intermediate fraction; and
(iii) a heavy fraction;
wherein the light fraction has a boiling range with a 5% boiling point of about 300° F., wherein the intermediate fraction has a boiling range with a 5% boiling point lower than that of the heavy fraction, and higher than that of the light fraction;
(d) passing at least a portion of the heavy fraction to a first hydroconversion zone containing a hydrocracking catalyst;
(e) reacting at least a portion of the heavy fraction from step (d) with hydrogen under hydrocracking promoting conditions in the first hydroconversion zone to form a first hydroconverted effluent;
(f) passing at least a portion of the first hydroconverted effluent to a second hydroconversion zone;
(g) passing at least a portion of the intermediate fraction to the second hydroconversion zone; and
(h) reacting at least a portion of the first hydroconverted effluent and at least a portion of the intermediate fraction with hydrogen in the second hydroconversion zone with a catalyst under conditions suitable to promote hydroisomerization, hydrocracking, dewaxing, or combinations thereof, to form a second hydroconverted effluent, wherein the portion of the intermediate fraction passed to the second hydroconversion zone and the portion of the first hydroconverted effluent passed to the second hydroconversion zone have lost their separate identities.

wherein at least one of the first and the second hydroconversion zones comprises a catalyst gradient, and further wherein the catalyst gradient has an acidity gradually decreasing along said hydroconversion zone.

13. The method of claim 1 wherein the catalysts in the first and second hydroconversion zones have the same hydrogenation component.

14. The method of claim 1 wherein the catalysts in the first and second hydroconversion zone comprise different hydrogenation components.

15. The method of claim 1 wherein the catalysts in the first and second hydroconversion zones comprise different cracking components.

16. The method of claim 1 wherein the catalyst in the second hydroconversion zone has a lower acidity than the catalyst in the first hydroconversion zone.

17. The method of claim 1 wherein the first and second hydroconversion zones are contained within a single vessel.

18. The method of claim 1 wherein the first and second hydroconversion zones are part of a continuous catalyst bed.

19. The method of claim 1 wherein the first and second hydroconversion zones are in separate vessels.

20. The method of claim 1 wherein the heavy fraction comprises a boiling range with a 5% point $T_H$ equal to or greater than about 640° F.

21. The method of claim 20 wherein the intermediate fraction comprises a boiling range with a 5% boiling point $T_I$ and a 95% boiling point $T_J$, wherein $T_J$ is between about $T_H$-100° F. and $T_H$+150° F., and wherein $T_I$, is between about 500° F. and $T_3$−50° F.

22. The method of claim 20 wherein the light fraction comprises a boiling range with a 5% boiling point between about 330° F. and about 350° F. and a 95% boiling point $T_k$, wherein $T_k$ is between about $T_I$−50° F. and $T_I$+50° F. if $T_I$ is less than 640° F., or $T_k$ is about equal to about 640° F. if $T_I$ is greater than about 640° F.

23. The method of claim 1 wherein the heavy fraction comprises hydrocarbons with 20 or more carbon atoms.

24. The method of claim 23 wherein the intermediate fraction comprises hydrocarbons having between about 15 and about 20 carbon atoms.

25. The method of claim 1 wherein the heavy fraction comprises hydrocarbons with 'n' or more carbon atoms, and the intermediate fraction comprises hydrocarbons having more than about 15 carbon atoms, but less than about 'n' carbon atoms, wherein 'n' is greater than 20.

26. The method of claim 1 wherein the second hydroconversion zone has an inlet temperature equal to or greater than that of the first hydroconverted effluent.

27. A method for increasing the degree of isomerization of a diesel product, derived from synthesis gas, comprising:

providing a hydrocarbon stream comprising $C_{5+}$ paraffins. wherein a majority of said $C_{5+}$paraffins are products of a hydrocarbon synthesis from synthesis wherein the products from the hydrocarbon synthesis have been first subjected to hydrotreating under mild hydrotreating conditions;

(a) providing a first fraction comprising $C_{20+}$ liquid hydrocarbons, wherein said first fraction has a 5% boiling point equal to or greater than about 640° F.;

(b) providing a second fraction comprising $C_{15}$-$C_{20}$ liquid hydrocarbons, (c) wherein said second fraction has a 5% boiling point between about 400° F. and about 550° F., and a 95% boiling point equal to or less than about 640° F., and (d) wherein the first and second fractions comprise primarily paraffins synthesized from synthesis gas;

(e) reacting at least a portion of the first fraction in a first hydroconversion zone to generate a first hydroconverted hydrocarbon product stream;

(f) reacting at least a portion of the second fraction in a second hydroconversion zone to generate a second hydroconverted hydrocarbon product stream;

(g) wherein at least a portion of the first hydroconverted hydrocarbon product stream is optionally fed to the second hydroconversion zone.

28. The method according to claim 27 further comprising fractionating at least a portion of the second hydroconverted hydrocarbon product stream to produce at least a middle distillate with a 5% boiling point between about 330° F. and about 350° F., and a 95% boiling point between about 500° F. and about 600° F.

29. The method according to claim 28 further comprising providing a third fraction, wherein the third fraction has a 5% boiling point between about 330° F. and about 350° F., and a 95% boiling point between about 400° F. and about 550° F. and forming a synthetic paraffinic diesel by blending (1) at least a portion of the third fraction; and (2) at least a portion of the middle distillate.

30. The method according to claim 29 wherein the synthetic paraffinic diesel blend further comprises at least a portion of the first hydroconverted hydrocarbon product stream, wherein said fraction of the first hydroconverted hydrocarbon product has a 5% boiling point between about 330° F. and about 350° F., and a 95% boiling point between about 500° F. and about 600° F.

31. The method according to claim 29 wherein the synthetic paraffinic diesel blend further comprises at least a portion of the second fraction not passed to the second hydroconversion zone.

32. The method according to claim 30 wherein the synthetic paraffinic diesel blend further comprises at least a portion of the second fraction not passed to the second hydroconversion zone.

33. The method according to claim 29 wherein the first and second fractions are hydrotreated prior to reaction in their respective hydroconversion zone.

34. The method according to claim 29 further comprising passing at least a portion of said first hydroconverted hydrocarbon product stream to the second hydroconversion zone.

35. The method of claim 34 wherein the second hydroconversion zone has an inlet temperature equal to or greater than that of the first hydroconverted hydrocarbon product stream.

36. A method for increasing the production yield of a diesel product, wherein the diesel product comprises primarily products derived from a hydrocarbon synthesis, said method comprises:

(a) providing a hydrocarbon stream comprising $C_{5+}$ paraffins, wherein a majority of said $C_{5+}$ paraffins are products of a hydrocarbon synthesis from synthesis gas wherein the products from the hydrocarbon synthesis have been first subjected to hydrotreating under mild hydrotreating conditions;

(b) separating by fractionation said hydrocarbon stream into at least (i) a wax fraction comprising a boiling range with a 5% boiling point $T_H$, wherein $T_H$ is equal to or greater than about 640° F.;

(ii) an intermediate fraction comprising a boiling range with a 5% boiling point $T_I$ and a 95% boiling point $T_J$, wherein $T_J$ is between about $T_H$−100° F. and $T_H$+150° F., and wherein $T_I$ is between about 500° F. and $T_J$−50° F.; and;

(iii) a middle distillate fraction comprising a boiling range with a 5% boiling point between about 330° F. and about 350° F. and a 95% boiling point $T_k$, wherein $T_k$ is between about $T_I$−50° F. and $T_I$+50° F. , if $T_I$ is less than about 640° F., or $T_k$ is equal to about 640° F. if $T_I$ is greater than 640° F.;

(c) passing at least a portion of the wax fraction in a first hydroconversion zone under hydrocracking promoting conditions to convert with hydrogen at least a portion of the wax fraction to form a first hydroconverted effluent;

(d) reacting in the presence of hydrogen the first hydroconverted effluent and at least a portion of intermediate fraction in a second hydroconversion reaction zone under suitable hydroconversion conditions to promote hydroisomerization, hydrocracking, dewaxing, or any combination thereof, to form a second hydroconverted effluent; and (e) feeding said second hydroconverted effluent to the fractionator of step (b), (f) forming a diesel product, wherein said diesel product comprises at least a portion of the resulting middle distillate fraction and optionally a portion of the intermediate fraction if $T_J$ is less than about 640° F.

37. The method of claim 36 wherein $T_H$ is about equal to about 640° F.; $T_J$ is about equal to about 640° F.; $T_I$ is between about 400° F. and about 600° F.; and $T_k$ is equal to about $T_I$.

38. The method of claim 36 wherein $T_H$ is about equal to about 640° F.; $T_J$ is between about 550° F. and about 800° F.; $T_I$ is between about 400° F. and about $T_J$−50° F.; and $T_k$ is equal to about $T_I$.

39. The method of claim 36 wherein $T_H$ is equal to about 800° F.; $T_J$ is between about 700° F. and about 850° F.; $T_I$ is between about 640° F. and about $T_J$−50° F.; and $T_k$ is equal to about 640° F.

40. The method of claim 36 wherein $T_H$ is about equal to about 900° F.; $T_J$ is between about 700° F. and about 900° F.; $T_I$ is between about 640° F. and about $T_J$−50° F.; and $T_k$ is equal to about 640° F.

41. The method of claim 36 further comprising passing the hydrocarbon stream in a hydrotreater under hydrotreating promoting conditions before step (b).

* * * * *